US009979500B2

(12) United States Patent
Raman et al.

(10) Patent No.: US 9,979,500 B2
(45) Date of Patent: May 22, 2018

(54) DYNAMIC USER INTERFACE RENDERING BASED ON USAGE ANALYTICS DATA IN A MEDIA CONTENT DISTRIBUTION SYSTEM

(75) Inventors: Sampath Raman, Tirunelveli (IN); Narendra B. Babu, Ashok Nagar (IN); Kokila Somasundaram, Virugambakkam (IN)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 299 days.

(21) Appl. No.: 13/224,643

(22) Filed: Sep. 2, 2011

(65) Prior Publication Data

US 2013/0061259 A1 Mar. 7, 2013

(51) Int. Cl.
*H04H 60/32* (2008.01)

(52) U.S. Cl.
CPC ..... *H04H 60/32* (2013.01)

(58) Field of Classification Search
USPC ..... 725/37–61
See application file for complete search history.

(56) References Cited

U.S. PATENT DOCUMENTS

| | | | | |
|---|---|---|---|---|
| 7,296,284 | B1 * | 11/2007 | Price et al. | 725/39 |
| 2002/0178257 | A1 * | 11/2002 | Cerrato | 709/224 |
| 2007/0250864 | A1 * | 10/2007 | Diaz Perez | 725/52 |
| 2008/0276277 | A1 * | 11/2008 | Ahn | H04N 5/44543 725/40 |
| 2011/0289534 | A1 * | 11/2011 | Jordan et al. | 725/48 |

* cited by examiner

*Primary Examiner* — Michael R Telan

(57) ABSTRACT

An exemplary method includes a media content access device, which is configured to access a media content service distributed over a media content distribution network, 1) detecting a request for a presentation of a user interface configured to facilitate usage of the media content service by a user of the media content access device, 2) determining, in response to the request, whether usage analytics data representative of a historical pattern of usage of the media content service is available, 3) rendering, if the usage analytics data is determined to be unavailable, a static default version of the user interface in accordance with data representative of a static default configuration of the user interface, and 4) rendering, if the usage analytics data is determined to be available, a dynamic version of the user interface based on the user analytics data. Corresponding methods, systems, and apparatuses are also disclosed.

25 Claims, 12 Drawing Sheets

DYNAMIC USER INTERFACE RENDERING BASED ON USAGE ANALYTICS DATA IN A MEDIA CONTENT DISTRIBUTION SYSTEM

BACKGROUND INFORMATION

The set-top box device has become an important device for accessing media content services (television programming services) distributed over a media content distribution network. A typical set-top box device renders a graphical user interface for display by a display device. Through the graphical user interface, an end user of media content services is able to interact with the set-top box device to access and use those services.

Conventionally, certain properties of a graphical user interface rendered by a set-top box device are fixed or static. To illustrate, a set-top box device may render and provide a graphical user interface screen for display by a display device. The screen may include fixed properties such as fixed visual layouts and/or screen locations of certain graphical elements within the graphical user interface. For example, the graphical user interface screen may be a menu screen that includes a fixed layout of a static set of selectable menu options. The menu layout may be fixed in that it occupies a fixed screen position within the graphical user interface screen and/or contains static menu options (e.g., the same set of menu options and/or a fixed order or arrangement of the menu options within the menu layout). Because the menu layout is fixed, the same menu layout is repeatedly rendered and displayed without modification to the fixed properties of the menu layout. Such static rendering of the menu layout may limit the potential quality of a user experience with the set-top box device and/or with the media content services accessed through the set-top box device.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION OF PREFERRED EMBODIMENTS

Figure 1:
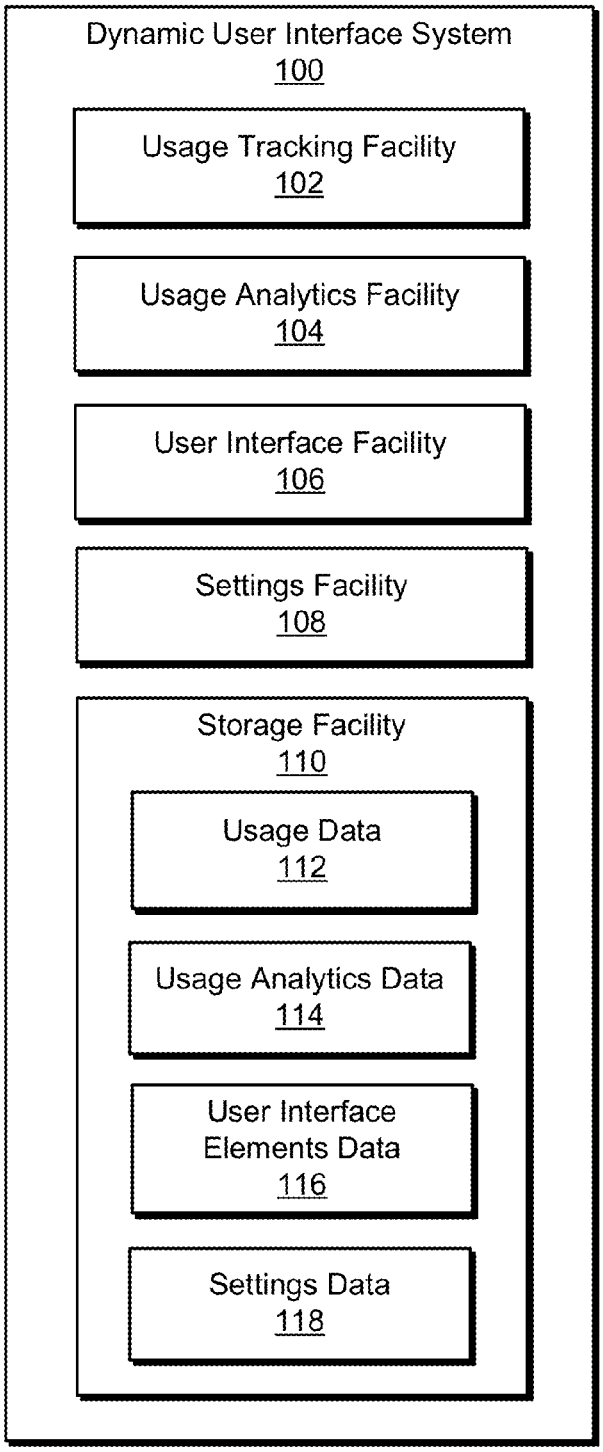
FIG. 1 illustrates an exemplary dynamic user interface system according to principles described herein.

Dynamic user interface systems, methods, and apparatuses are disclosed herein. As described herein, the dynamic user interface systems, methods, and apparatuses may be implemented in a media content distribution system (e.g., a subscriber television programming distribution system) configured to distribute a media content service (e.g., a subscriber television programming service) and may dynamically render or otherwise dynamically build a user interface based on usage analytics data representative of one or more patterns of end-user usage of the media content service in the media content distribution system.

For example, the dynamic user interface systems, methods, and apparatuses may collect usage data representative of end-user usage of a media content service (e.g., usage of one or more features, user interfaces, devices of the media content service) over time and process (e.g., analyze the usage data to identify one or more distinct usage patterns) the collected usage data to generate usage analytics data representative of one or more historical patterns of end-user usage of the media content service.

The dynamic user interface systems, methods, and apparatuses may dynamically render a user interface based on the usage analytics data. For example, a media content access device in a media content distribution system may detect a request for a presentation of a user interface configured to facilitate usage of the media content service by a user of the media content access device, determine, in response to the request, whether usage analytics data representative of a historical pattern of usage of the media content service is available, rendering, if the usage analytics data is determined to be unavailable, a static default version of the user interface in accordance with data representative of a static default configuration of the user interface, and rendering, if the usage analytics data is determined to be available, a dynamic version of the user interface based on the user analytics data. The rendering of the dynamic version of the user interface may dynamically customize one or more properties of the user interface (e.g., properties that would otherwise be static in the static default version of the user interface) based on the usage analytics data, such as in any of the ways described herein. Such historical-usage-based dynamic customization of the user interface may enhance an experience of a user utilizing the user interface to access and use the media content service, or to otherwise interact with the media content distribution system. Examples of historical usage patterns and dynamic customization of properties of a user interface based on the usage patterns are described herein.

Exemplary dynamic user interface systems, methods, and apparatuses, as well as exemplary media content distribution systems, methods, and equipment that implement the dynamic user interface systems and methods will now be described in reference to the drawings.

FIG. 1 illustrates an exemplary dynamic user interface system 100 (or simply "system 100"). As will be described in more detail herein, system 100 may be configured to dynamically render a user interface based on usage analytics data in a media content distribution system. As shown, system 100 may include, without limitation, a usage tracking facility 102, a usage analytics facility 104, a user interface facility 106, a settings facility 108, and a storage facility 110, which may be in communication with one another using any suitable communication technologies. It will be recognized that although facilities 102-110 are shown to be separate facilities in FIG. 1, any of facilities 102-110 may be combined into fewer facilities, such as into a single facility, or divided into more facilities as may serve a particular implementation.

Usage tracking facility 102 may be configured to track end-user usage of a media content service distributed by a media content distribution system, which may include any end-user usage of (e.g., interaction with) components (e.g., media content access devices, media content distribution network devices, etc.), features, media content (e.g., media content programs) associated with the service, user interfaces (e.g., user interfaces through which users are able to access or otherwise interact with the media content service or related devices), features, and/or functionality of the media content service. For example, the media content distribution system may distribute a media content service for access by an end-user media content access device. Usage tracking facility 102 may track end-user usage of the media content service, which may include any end-user usage of (e.g., interaction with) the media content access device related to the media content service.

Usage tracking facility 102 may be configured to track usage data by performing any of the usage tracking operations described herein, including by collecting, over time, usage data (e.g., raw usage data) representative of usage of a media content service. Hence, as used herein, "usage data" may include, without limitation, any data representative of or otherwise associated with end-user usage of a media content service.

Usage analytics facility 104 may be configured to process usage data collected by usage tracking facility 102. For example, usage analytics facility 104 may analyze the usage data to identify one or more usage patterns (e.g., multiple distinct usage patterns) and to generate usage analytics data based on and/or representative of the identified historical usage patterns. A usage pattern may include any detectable pattern of usage of a media content service. Hence, as used herein, "usage analytics data" may include, without limitation, any data representative of one or more historical patterns of end-user usage of a media content service. Usage analytics facility 104 may be configured to process usage data and generate usage analytics data from the usage data in any of the ways described herein.

User interface facility 106 may be configured to provide a user interface through which one or more users may access, use, and/or otherwise interact with a media content service and/or one or more components of a media content distribution system that distributes the service. For example, user interface facility 106 may be configured to generate and provide a user interface through which one or more users of a media content access device of the media content distribution system may control or otherwise interact with the media content access device to access and use the media content service. In certain examples, the user interface may include a graphical user interface ("GUI") configured to be displayed for interaction by the users. The GUI may include one or more GUI screens, each of which may be rendered by user interface facility 106 for display on a display screen. For example, user interface facility 106 may render a GUI screen that includes a menu of options with which a user may interact to navigate, select, access, control, or otherwise interact with the media content service and/or the media content access device. Exemplary GUI screens are described in detail herein.

User interface facility 106 may be configured to dynamically render a user interface (e.g., a GUI screen of a GUI) based on usage analytics data generated and maintained by usage analytics facility 104. To illustrate, user interface facility 106 may detect a request that a GUI screen be rendered for display. In response, user interface facility 106 may access and use usage analytics data to dynamically render the GUI screen such that one or more properties of the GUI screen are dynamically customized based on the usage analytics data. Accordingly, one or more properties of the GUI screen may be dynamically customized during rendering of the GUI screen based on historical usage patterns. The dynamic customization of the GUI screen may allow user interface facility 106 to render a dynamic, custom version of the GUI screen that is different from a static, default version of the GUI screen. For example, a default version of the GUI screen may include a particular visual layout of graphical elements (e.g., a default layout of graphical icons representing menu options). Instead of simply rendering this default version of the GUI screen, user interface facility 106 may determine that usage analytics data is available and access and use the usage analytics data to dynamically render a custom version of the GUI screen that includes a different visual layout of graphical elements (e.g., a custom layout of graphical icons representing menu options). User interface facility 106 may be configured to dynamically render the GUI screen and/or other user interface in any of the ways described herein. Examples of dynamically rendered user interfaces are described herein.

Settings facility 108 may be configured to maintain settings associated with functionality of usage tracking facility 102, usage analytics facility 104, and/or user interface facility 106. For example, settings facility 108 may maintain settings for use by tracking facility 102, usage analytics facility 104, and/or user interface facility 106 in tracking usage of a media content service, analyzing usage data, generating usage analytics data, and/or dynamically rendering a user interface. Examples of such settings may include, without limitation, settings specifying one or more types of usage of a media content service to be tracked, how to analyze collected usage data, the data to be included in generated usage analytics data, and/or how the usage analytics data is to be applied to dynamically render a user interface based on the usage analytics data.

The settings maintained by settings facility 108 may include settings defined by an end user of a media content service and/or a provider of the media content service (e.g., an operator of media content distribution network equipment that distributed the media content service over a media content distribution network). Hence, in certain examples, an end-user may define one or more settings specifying one or more types of usage of a media content service to be tracked, how to analyze collected usage data, the data to be included in generated usage analytics data, and/or how the usage analytics data is to be applied to dynamically render a user interface based on the usage analytics data. Exemplary settings are described herein.

Storage facility 110 may be configured to store usage data 112 collected by usage tracking facility 102, usage analytics data 114 generated by user analytics facility 104, user interface elements data 116 representative of one or more user interface elements to be used by user interface facility 106 in generating a user interface (e.g., graphical elements associated with a GUI), and settings data 118 representative of settings maintained by settings facility 108. Storage facility 110 may be configured to maintain additional and/or alternative data as may suit a particular implementation.

Figure 2:
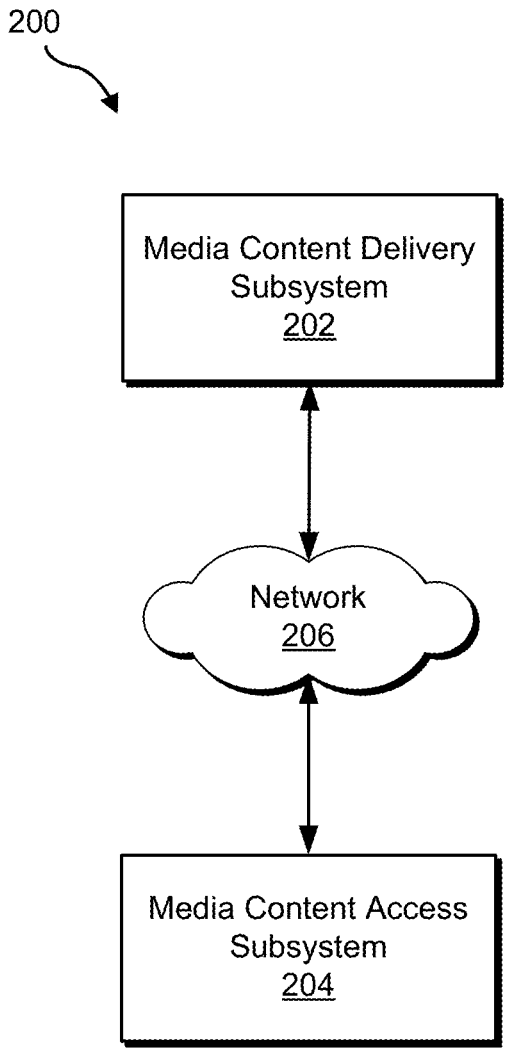
FIG. 2 illustrates an exemplary media content distribution system according to principles described herein.

In the above-described or a similar manner, system 100 may be configured to dynamically render a user interface based on usage analytics data in a media content distribution system. The media content distribution system may include any configuration of computing and/or other electronic devices and/or equipment configured to distribute a media content service and media content associated with the service for access and consumption by one or more end users of the service. FIG. 2 illustrates an exemplary media content distribution system 200 (or simply "system 200") in which system 100 is implemented. As shown, system 200 may include a media content delivery subsystem 202 (or simply "delivery subsystem 202") communicatively coupled to a media content access subsystem 204 (or simply "access subsystem 204"). Any of the facilities 102-110 of system 100 may be implemented by one or both of delivery subsystem 202 and access subsystem 204.

Access subsystem 204 and delivery subsystem 202 may communicate with one another using any suitable communication technologies, devices, networks, media, and protocols supportive of remote data communications. For example, as shown in FIG. 2, delivery subsystem 202 may be configured to communicate with access subsystem 204 over a network 206. Network 206 may include one or more networks or types of networks (and communication links thereto) capable of carrying communications, media content, and/or data signals between delivery subsystem 202 and access subsystem 204. For example, network 206 may include, but is not limited to, one or more media content distribution networks, one or more wireless networks (e.g., satellite media broadcasting networks or terrestrial broadcasting networks), mobile telephone networks (e.g., cellular telephone networks and/or mobile telephone data networks), closed media networks, open media networks, subscriber television programming distribution networks (e.g., broadcast, multicast, and/or narrowcast television networks), closed communication networks, open communication networks, satellite networks, cable networks, hybrid fiber coax networks, optical fiber networks (e.g., fiber-to-the-premises networks), broadband networks, narrowband networks, the Internet, wide area networks, local area networks, public networks, private networks, packet-switched networks, and any other networks capable of carrying data, media content, and/or communications signals between delivery subsystem 202 and access subsystem 204. Communications between delivery subsystem 202 and access subsystem 204 may be transported using any one of above-listed networks, or any combination or sub-combination of the above-listed networks.

Delivery subsystem 202 and access subsystem 204 may communicate over network 206 using any communication platforms and technologies suitable for transporting media content and/or communication signals, including known communication technologies, devices, transmission media, and protocols supportive of remote data communications, examples of which include, but are not limited to, data transmission media, communications devices, Transmission Control Protocol ("TCP"), Internet Protocol ("IP"), File Transfer Protocol ("FTP"), Telnet, Hypertext Transfer Protocol ("HTTP"), Hypertext Transfer Protocol Secure ("HTTPS"), Session Initiation Protocol ("SIP"), Simple Object Access Protocol ("SOAP"), Extensible Mark-up Language ("XML") and variations thereof, Simple Mail Transfer Protocol ("SMTP"), Real-Time Transport Protocol ("RTP"), User Datagram Protocol ("UDP"), Global System for Mobile Communications ("GSM") technologies, Code Division Multiple Access ("CDMA") technologies, Evolution Data Optimized Protocol ("EVDO"), Time Division Multiple Access ("TDMA") technologies, radio frequency ("RF") signaling technologies, wireless communication technologies (e.g., Bluetooth, Wi-Fi, etc.), optical transport and signaling technologies, live transmission technologies (e.g., media streaming technologies), media file transfer technologies, media data formats, in-band and out-of-band signaling technologies, and other suitable communications technologies.

Delivery subsystem 202 and access subsystem 204 may provide users of access subsystem 204 with access to one or more media content services, including access to any media content, features, and/or functionality of the service(s). For example, delivery subsystem 202 may be configured to distribute a media content service (e.g., a television programming service such as a television programming broadcast, multicast, or narrowcast service) for access by access subsystem 204. In certain embodiments, the media content service may include a subscriber television programming service configured to broadcast or multicast television programming over a television programming distribution network in accordance with a predefined presentation or transmission schedule.

One or more end users of the media content service may utilize access subsystem 204 to access the media content service distributed by delivery subsystem 202. Access subsystem 204 may be configured to process (e.g., record, store, play back) media content (e.g., broadcast, multicast, or narrowcast television programming) associated with the media content service to facilitate a user of access subsystem 204 experiencing the media content. Accordingly, end users of the media content service may utilize access subsystem 204 to access and experience the media content distributed through the media content service.

Delivery subsystem 202 may include or be implemented by one or more computing and/or other electronic devices (e.g., one or more server devices, routers, switches, gateways, media hob devices, etc.) configured to perform any of the operations described herein for distribution of a media content service for access by access subsystem 204. Complimentarily, access subsystem 204 may include or be implemented by one or more computing and/or other electronic devices (e.g., one or more set-top box ("STB") devices, gaming devices, media player devices, digital video recording ("DVR") devices, personal computers, tablet computers, mobile phones, etc.) configured to perform any of the operations described related to accessing a media content service distributed by delivery subsystem 202. Any of these devices, or any additional or alternative devices included in or implemented by delivery subsystem 202 and/or access subsystem 204, may be configured to perform any of the media content distribution, media content access, and/or dynamic user interface operations described herein.

For example, delivery subsystem 202 may be configured to distribute a media content service over network 206, and one or more end users of the media content service may utilize access subsystem 204 to access the media content service. Delivery subsystem 202 may be further configured to track end-user usage of the media content service over time, such as by tracking end-user usage of the media content service, which may include user interaction with one or more media content access devices included in access subsystem 204 in relation to accessing the media content service. To illustrate, a user may interact with a media content access device, which may send raw usage data representative of the user interaction with the media content access device and/or other usage of the media content service to delivery subsystem 202. Delivery subsystem 202 may be configured to process the raw usage data to generate usage analytics data representative of one or more historical patterns of usage of the media content service.

A particular media content access device included in media content access subsystem 204 may detect a request to render a user interface. In response to the request, the media content access device may determine whether usage analytics data related to the requested user interface is available. For example, the media content access device may determine whether a connection with delivery subsystem 202 is available and, if a connection is available, the media content access device may query delivery subsystem 202 for available usage analytics data. If usage analytics data is not available, delivery subsystem 202 may notify access subsystem 204. Alternatively, the media content access device may determine that a connection between the media content access device and delivery subsystem 202 is temporarily unavailable, which would make the usage analytics data unavailable. In either way, the media content access device may determine that usage analytics data is not available and, in response, use a static default configuration of the user interface stored within access subsystem 204 to render a static version of the user interface in accordance with the default configuration. If, on the other hand, relevant usage analytics data is determined to be available, delivery subsystem 202 may transmit the usage analytics data to access subsystem 204, which may then dynamically render a dynamic version of the user interface based on the usage analytics data, such as in any of the ways described herein.

Figure 3:
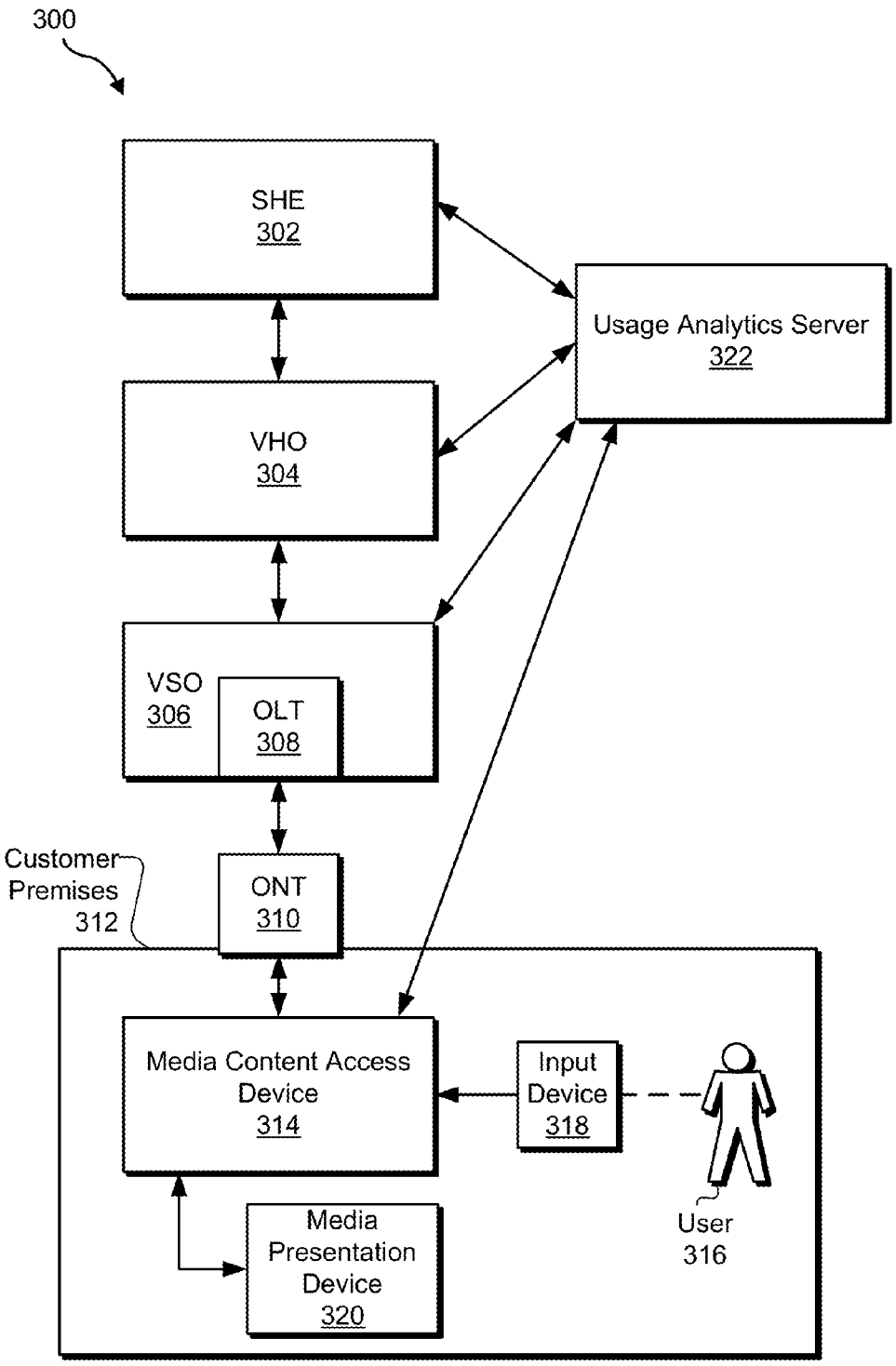
FIG. 3 illustrates an exemplary implementation of the system of FIG. 2 according to principles described herein.

To further illustrate functionality of system 200, an exemplary implementation of system 200 will now be described. FIG. 3 shows an exemplary implementation 300 of system 200. Implementation 300 may be configured to distribute a media content service to one or more end users of the service. The service may include a television programming service, a video service (e.g., a video-on-demand service), an audio service, any other media content service, or a combination or sub-combination thereof. In some embodiments, the media content service may include different tiers of service for different subscription levels. For example, the media content service may include different packages of television programming channels configured to be made available based on subscription levels of end users of the service.

As shown in FIG. 3, implementation 300 may include a super head-end ("SHE") 302, a video hub office ("VHO") 304, and a video service office ("VSO") 306 communicatively coupled to one another as shown. SHE 302, VHO 304, and VSO 306 may include or be implemented by network node equipment (e.g., media content distribution network equipment) configured to distribute one or more media content services. For example, SHE 302 may transmit a media signal (e.g., a video signal) carrying media content (e.g., video content) to VHO 304. VHO 304 may receive the media signal and aggregate it with any other media signals received from other sources (e.g., from another SHE). VHO 304 may in turn transmit a signal carrying the media content to VSO 306, which may transmit the signal to one or more customer premises. For example, VSO 306 may include an optical line terminal ("OLT") 308 configured to transmit optical signals carrying the media content over an optical fiber connection to an optical network terminal ("ONT") 310 located at (e.g., within or adjacent to) a customer premises 312. In certain embodiments, SHE 302, VHO 304, and VSO 306 may be part of delivery subsystem 202 and/or network 206 of system 200, and ONT 310 may include a network interface device located at an edge of network 206 of system 200.

Implementation 300 may be configured to distribute one or more types of media services. In certain embodiments, for example, implementation 300 may be configured to broadcast and/or multicast signals carrying media content in accordance with a predefined transmission or presentation schedule (e.g., a television programming schedule). To this end, SHE 302 may transmit a media signal to VHO 304 during a time period specified by the transmission schedule. VHO 304 may receive and transmit the signal to VSO 306, which may transmit the signal from OLT 308 to ONT 310 during the time period such that a media content access device 314 located within customer premises 312 and communicatively coupled to ONT 310 may access and process the signal during the time period specified by the transmission schedule.

In certain embodiments, media content access device 314 may be configured to access the signal by tuning to a media content carrier channel associated with a particular frequency band within which the signal is transmitted by VSO 306. The media content carrier channel may be mapped to a virtual programming channel by media content access device 314 such that a user 316 of media content access device 314 may provide input to direct the media content access device 314 to access a particular virtual programming channel, which causes the media content access device 314 to tune to the corresponding media content carrier channel in order to access the signal being transmitted on that media content carrier channel. The media content access device 314 may process the signal (e.g., down-convert and/or decode the signal) to access, process, and present the media content carried by the signal.

Implementation 300 may be configured to concurrently transmit multiple media content programs for selective, authorized access by media content access device 314. For example, user 316 of media content access device 314 may subscribe to a media programming package, which subscription allows VSO 306, VHO 304, and/or SHE 302 to authorize media content access device 314 to access any media content included in the package. To illustrate, the package may include a particular set of programming channels. Accordingly, media content access device 314 may tune to any of the programming channels in the package to access the media content (e.g., television content) carried by the media content carrier channel associated with the selected programming channel. When user 316 directs media content access device 314 to tune to a particular channel, the media content access device 314 may send a conditional access ("CA") signal upstream to request authorization to access the channel. SHE 302, VHO 304, or VSO 306 may be equipped to maintain user subscription data that may be checked against the CA signal to determine whether user 316 has a subscription package that authorizes user 316 to access the particular channel. If authorization is granted, the media content access device 314 is allowed to access the particular channel. The authorization may be given in any suitable way, such as by distributing one or more encryption keys to the media content access device 314 for use in decrypting encrypted content carried by the channel.

In certain embodiments, implementation 300 may be configured to distribute media content as follows. SHE 302 may acquire media content from one or more content providers. For example, SHE 302 may acquire media content such as national television programs and/or advertisements from providers such as ESPN, Lifetime, Weather Channel, etc. The media content may be acquired from one or more satellite feeds and/or any other suitable sources of content. SHE 302 may process the received media content to form a national channel lineup and distribute the media content to VHO 304.

VHO 304 may receive the media content from SHE 302. VHO 304 may also acquire media content from one or more local sources (e.g., local content providers such as ABC, NBC, CBS, and/or affiliates, local broadcast channels, over-the-air programming, etc.) VHO 304 may process the acquired media content to form a local channel lineup. VHO 304 may distribute the acquired media content (both a national and a local channel lineup) to VSO 306. VSO 306 may also generate and distribute data for use by media content access device 314 in providing an electronic program guide ("EPG").

VSO 306 may receive media content from VHO 304 and transmit the media content for access by media content access device 314. For example, OLT 308 of VSO 306 may transmit optical signals carrying the media content to ONT 310 (e.g., by way of a passive optical network ("PON") connection). In this or a similar manner, media content such as broadcast or multicast television content may be distributed for access by media content access device 314 in accordance with a predefined transmission or presentation schedule.

Additionally or alternatively to such a media content service, implementation 300 may distribute one or more other types of media content services and/or media content. For example, VHO 304 may be configured to distribute an on-demand media service such as a video-on-demand service. Accordingly, media content access device 314 may request and receive a narrowcast signal carrying on-demand content from VHO 304.

Additionally or alternatively, implementation 300 may distribute additional or alternative media content services and/or media content, such as pay-per-view ("PPV") content, gaming content, and/or Internet services content for access by media content access device 314.

Media content access device 314 may comprise any computing and/or other electronic device configured to access one or more services distributed by delivery subsystem 202 of system 200, which may include or be implemented by equipment at SHE 302, VHO 304, and/or VSO 306. In certain embodiments, media content access device 314 is a set-top box device located at a customer premises 312 of a user 316 (e.g., a subscriber to a service distributed by delivery subsystem 202). User 316 may utilize an input device 318 such as an infrared or other wireless remote control device to provide input to direct the operation of media content access device 314. Media content access device 314 may generate and provide an output signal to a media presentation device 320 such as a television having a display screen for processing by the media presentation device 320 to present media content for experiencing by user 316.

Figure 4:
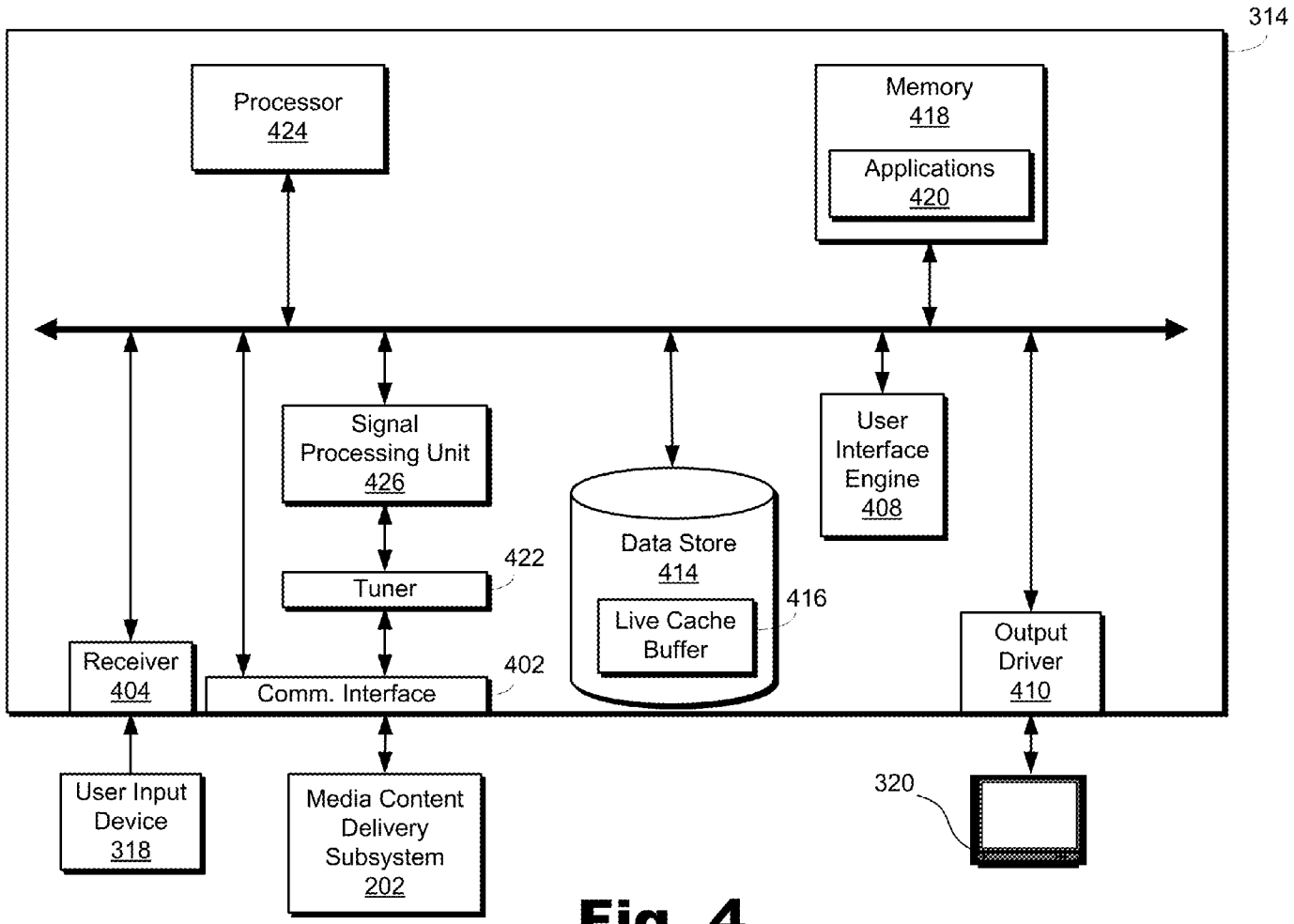
FIG. 4 illustrates an exemplary media content access device according to principles described herein.

FIG. 4 illustrates exemplary components of media content access device 314. As shown in FIG. 4, device 314 may include a communication interface 402 configured to receive media content and/or data (e.g., media content service data, program guide data, and/or any other data associated with a media content service) in any acceptable format from delivery subsystem 202 or from any other suitable external source. Communication interface 402 may include any device, logic, and/or other technologies suitable for receiving communications, signals, and/or data representative of media content or other data. Communication interface 402 may be configured to interface with any suitable communication media, protocols, and formats, including any of those mentioned above.

Device 314 may include a receiver 404 configured to receive user input signals from input device 318. Input device 318 may include, for example, a remote control device or any other suitable input device and may be configured to communicate with receiver 404 via a wireless link, electrical connection, or any other suitable communication link.

Device 314 may include a user interface engine 408 and an output driver 410. User interface engine 408 may be configured to generate a user interface to be provided by device 314 to facilitate user interaction with device 314 (which may facilitate end-user usage of a media content service). For example, user interface engine 408 may render a GUI screen included in a GUI in any of the ways described herein. User interface engine 408 may provide data representative of a rendered GUI screen to output driver 410, which may be configured to interface with or drive media presentation device 320. Output driver 410 may provide output signals to media presentation device 320, the output signals including user interface content and/or media content generated by user interface engine 408 and to be presented by media presentation device 320 for experiencing by user 316. For example, output driver 410 may provide data representative of a GUI screen including a device menu screen view, a program guide view, or a media playback view to media presentation device 320 for presentation to user 316.

User interface engine 408 may be configured to perform any of the dynamic user interface rendering operations described herein. Accordingly, user interface engine 408 may dynamically render a user interface based on usage analytics data as described herein.

Data store 414 may include one or more data storage media, devices, or configurations and may employ any type, form, and combination of storage media. For example, data store 414 may include, but is not limited to, a hard drive, network drive, flash drive, magnetic disc, optical disc, or other non-volatile storage unit. Media content and/or data associated with media content may be temporarily and/or permanently stored in data store 414.

Data store 414 is shown to be included within device 314 in FIG. 4 for illustrative purposes only. It will be understood that data store 414 may additionally or alternatively be located external to device 314.

Data store 414 may include one or more live cache buffers 416. Live cache buffer 416 may additionally or alternatively reside in memory 418 or in a storage device external to device 314. In some examples, media content data may be temporarily stored in live cache buffer 416 to facilitate recording of media content and/or presentation of media content in one or more trick play modes.

Device 314 may include memory 418. Memory 418 may include, but is not limited to, FLASH memory, random access memory ("RAM"), dynamic RAM ("DRAM"), other suitable non-transitory computer-readable media, or any combination or sub-combination thereof. In some examples, one or more applications 420 configured to run on or otherwise be executed by device 314 may reside in memory 418. Applications 420 may be configured to direct a processor 424 to perform one or more operations of device 314.

Device 314 may include one or more tuners 422. Tuner 422 may be configured to selectively receive media content carried on a particular content carrier channel such that the media content may be processed by device 314. In some examples, media content received by tuner 422 may be temporarily buffered, or stored, in the live cache buffer 416. If there are multiple tuners 422, there may be a live cache buffer 416 corresponding to each of the tuners 422.

While tuner 422 may be used to receive certain media content-carrying signals transmitted by delivery subsystem 202, device 314 may be configured to receive other types of media content signals (including media content signals and/or program guide data signals) from delivery subsystem 202 and/or one or more other sources without using a tuner. For example, delivery subsystem 202 may transmit digital streams of data packets (e.g., Internet Protocol ("IP") based data packets) that can be received without using a tuner. For such types of media content signals, communication interface 402 may receive and forward the signals directly to other components of device 314 (e.g., processor 424 or signal processing unit 426) without the signals going through tuner 422. For an IP-based signal, for example, signal processing unit 426 may function as an IP receiver.

Device 314 may include at least one processor, such as processor 424, configured to control and/or perform one or more operations of device 314. Device 314 may also include a signal processing unit 426 configured to process incoming media content signals. Signal processing unit 426 may be configured, for example, to demodulate, decode, and parse digital media content. In some examples, device 314 may include one or more signal processing units 426 corresponding to each of the tuners 422.

Returning to FIG. 3, implementation 300 may be configured to distribute a media content service and to track end-user usage of the media content service. The tracking may include collecting raw usage data representative of usage of the media content service over time and generating usage analytics data from the collected usage data. Implementation may additionally render a user interface based on the usage analytics in any of the ways described herein. To illustrate, user 316 may utilize input device 318 to interact with media content access device 314 to direct the media content access device 314 to access and/or perform one or more operations related to the media content service. Examples of such user interactions may include, without limitation, launching a GUI (e.g., a GUI application within applications 420), requesting display of a GUI screen, selecting menu options displayed in a GUI screen, selecting media content to be accessed (e.g., tuning to a channel carrying a media content program, accessing an on-demand media program, renting or purchasing media content, etc.), accessing a particular feature and/or function of media content access device 314 and/or the media content service (e.g., a DVR feature), purchasing or upgrading a service subscription package, and any other user interactions with media content access device 314. By interacting with media content access device 314, user 316 may access and use the distributed media content service, media content associated with the service, and/or any other features or functionality of media content access device 314 and/or media content service. Implementation 300 may be configured to track such interactions and/or other usage related to the distributed media content service.

As mentioned, tracking of usage data may include implementation 300 collecting usage data representative of usage of the media content service over time. Implementation 300 may collect the usage data in any way that is suitable for implementation 300 to generate usage analytics data representative of one or more historical patterns of usage of the media content service. For example, media content access device 314 may be configured to provide, over time, data representative of one or more operations of media content access device 314 to a usage analytics server 322 included in implementation 300.

The tracked usage data may be provided from media content access device 314 to usage analytics server 322 in any suitable way. For example, media content access device 314 may be configured to provide usage data directly to usage analytics server 322. Additionally or alternatively, media content access device 314 may be configured to provide usage data to one or more upstream network node devices included in implementation 300. For instance, media content access device 314 may provide usage data to VSO 306, VHO 304, and/or SHE 302, which may be configured to forward the usage data to usage analytics server 322. In certain examples, at least part of the usage data provided by media content access device 314 to usage analytics server 322 may be provided by way of CA signals to VHO 304. The CA signals may include usage data representative of one or more operations of media content access device 314. Accordingly, VHO 304 may receive and maintain data representative of the operations of media content access device 314, such as data indicating media content accessed by media content access device 314, one or more channels accessed by media content access device 314, services packages and/or subscriptions associated with media content access device 314, and/or any other information indicative of operations of media content access device 314 related to accessing the media content service. VHO 304 may provide (e.g., forward) raw usage data received from media content access device 314, such as usage data included in CA signals, to usage analytics server 322. In this manner, usage data may be provided by media content access device 314 indirectly to usage analytics server 322.

Usage analytics server 322 may be configured to receive raw usage data provided by media content access device 314 directly and/or indirectly to usage analytics server 322. Usage analytics server 322 may process the raw usage data and generate, from the raw usage data, usage analytics data representative of one or more patterns of usage related to the media content service. For example, usage analytics server 322 may be configured to analyze the raw usage data to identify one or more patterns of usage. Examples of such patterns of usage may include, without limitation, frequency of access of a particular feature, function, and/or media content program by media content access device (e.g., how frequently media content access device 314 accesses a particular function, feature, etc.), frequency of access of user interface elements such as menus, selectable menu options, parental controls, menu navigational options, GUI screens, and/or any other user interface elements, frequency with which a particular type of channel (e.g., a sports channel) and/or media content (e.g., genre of media content such as a genre of movies the media content access device 314 is renting or purchasing from a video-on-demand store), frequency with which a particular type of service subscription package is being provisioned by or for media content access device 314, media playback patterns, media recording patterns, and/or any other patterns of usage of a media content service that may be determined from raw usage data provided by media content access device 314.

Usage analytics data may include other information representative of usage of a media content service. For example, usage analytics data may be generated by usage analytics server 322 to include data indicating preferences of a user of media content access device 314, such as a list of favorite channels, a list of favorite media content programs, user ratings of media content programs, and/or other preferences indicted directly by a user.

Figure 5:
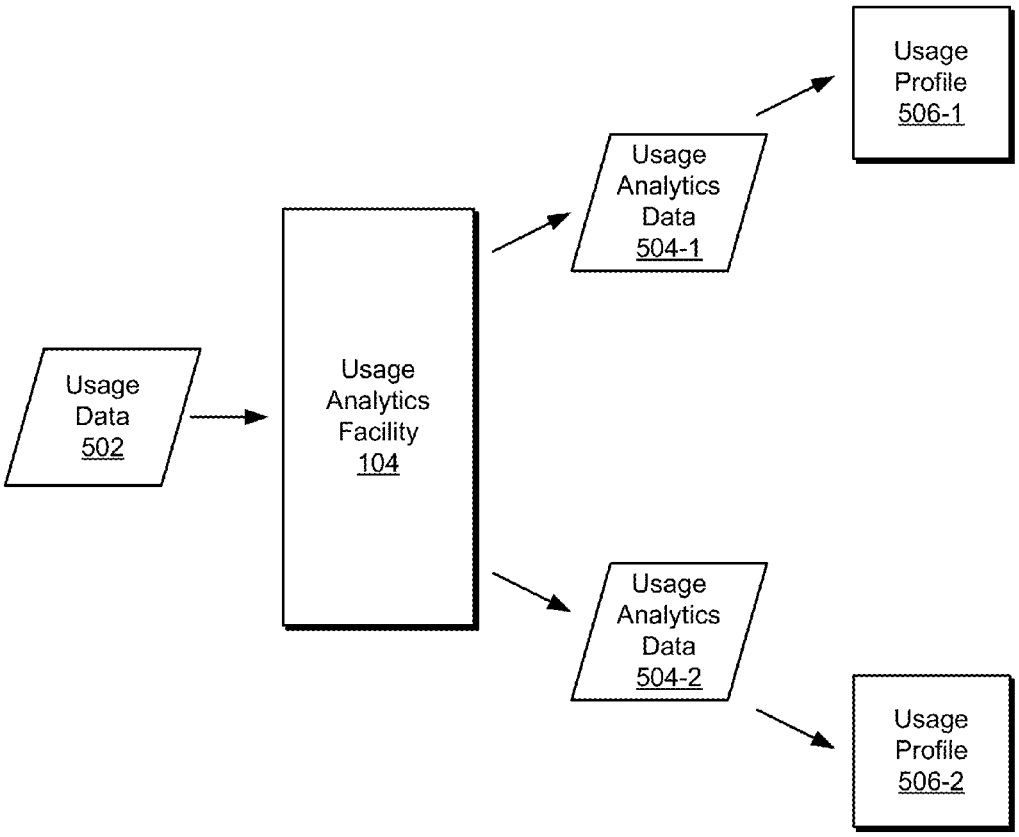
FIG. 5 illustrates a usage analytics facility generating and storing sets of usage analytics data to multiple usage profiles according to principles described herein.

In certain embodiments, usage analytics server 322 may be configured to analyze raw usage data to identify distinct patterns of usage and to generate and maintain one or more usage profiles for the distinct usage patterns. To illustrate, FIG. 5 shows usage analytics facility 104, which may be implemented by usage analytics server 322, receiving raw usage data 502. Usage analytics facility 104 may analyze usage data 502 and identify multiple distinct patterns of usage from the usage data 502. Distinct patterns of usage may be identified in any suitable way. As an example, certain usage data may indicate frequent accessing of channels that carry sports programming, while other usage data may indicate little or no accessing of such sports channels and frequent accessing of channels that carry cartoons or other children's programming. Usage analytics 322 may detect these distinct usage patterns and separate and use the usage data for each usage pattern to generate a different set of usage analytics data for each distinct usage pattern. For example, FIG. 5 shows a usage analytics facility 104 generating and outputting a first set of usage analytics data 504-1 and a second set of usage analytics data 504-2. Usage analytics data 504-1 may contain usage analytics data representative of a first distinct historical usage pattern, and usage analytics data 504-2 may contain data representative of a second distinct historical pattern of usage.

As shown in FIG. 5, each set of usage analytics data may be stored to a separate usage profile. For example, usage analytics data 504-1 may be stored to a first usage profile 506-1, and usage analytics data 504-2 may be stored to a second usage profile 506-2. Accordingly, each of the separate usage profiles 506-1 and 506-2 may include a set of usage analytics data 504 representative of a particular, distinct usage pattern. For instance, usage analytics data 504-1 included in usage profile 506-1 may represent a distinct usage pattern in which sports channels are accessed with frequency, and usage analytics data 504-2 included in usage profile 506-2 may represent a distinct usage pattern in which children's channels are accessed with frequency.

Figure 6:
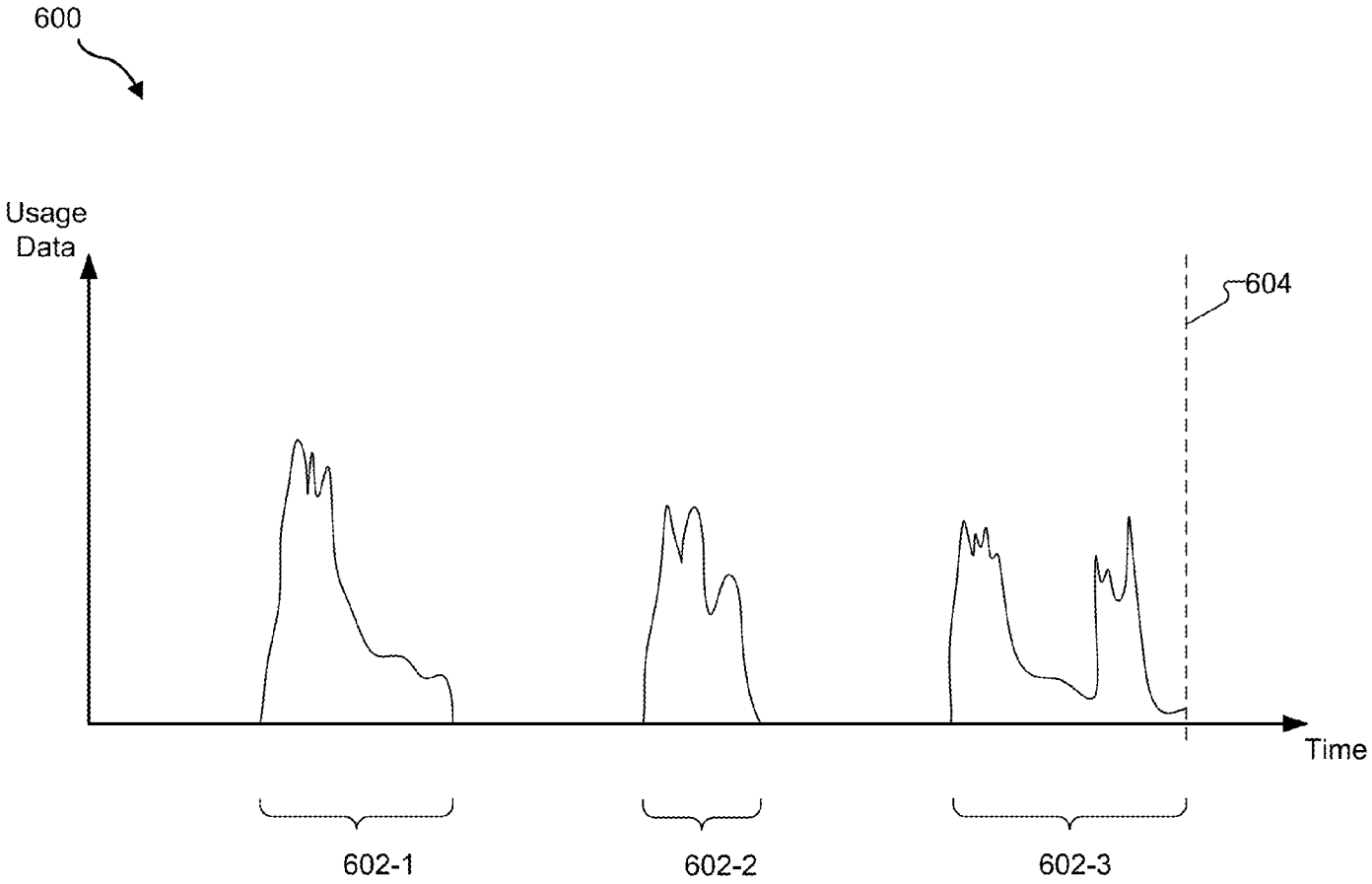
FIG. 6 illustrates a plot of usage data against time according to principles described herein.

From multiple usage profiles including usage analytics data representing distinct usage patterns, a "best fit" usage profile may be selected for use in dynamic rendering of a user interface based on the usage analytics data included in the usage profile. To illustrate, FIG. 6 shows a plot 600 of usage data (Y-axis) against time (X-axis). The usage data in FIG. 6 may represent usage data provided by media content access device 314. As shown, over time, there may be time periods during which media content access device 314 provides little or no usage data. This may occur when media content access device 314 is powered off or in standby mode. In addition, there are time periods during which media content access device 314 provides usage data. For example, media content access device 314 may provide a first set of usage data during a first time period 602-1, a second set of usage data during a second time period 602-2, and a third set of usage data during a third time period 602-3. Usage analytics server 322 may receive and analyze the first set of usage data, identify a first usage pattern (e.g., frequent accessing of sports channels), generate a first set of usage analytics data 504-1 from the first set of usage data, and store the first set of usage analytics data 504-1 to a first usage profile 506-1. Subsequently, usage analytics server 322 may receive and analyze the second set of usage data, identify a second usage pattern (e.g., frequent accessing of children's channels), generate a second set of usage analytics data 504-2 from the second set of usage data, and store the second set of usage analytics data 504-2 to a second usage profile 506-2. Subsequently, usage analytics server 322 may receive and analyze the third set of usage data, identify a usage pattern that is similar to the first usage pattern (e.g., frequent accessing of sports channels) from the third set of usage data, generate a third set of usage analytics data from the third set of usage data, and store the third set of usage analytics data to the first usage profile 506-1 along with the first set of usage analytics data 504-1. The storage of the third set of usage analytics data to the first usage profile 506-1 may include updating the usage analytics data in the first usage profile 506-1 in view of an aggregate effect produced by a combination of the first and third sets of usage analytics data. In this or a similar manner, usage analytics server 322 may track distinct historical usage patterns.

Usage analytics server 322 may continue to track usage patterns, including current usage patterns from usage data provided by media content access device 314 at a current time 604. Usage analytics server 322 may match the usage patterns at the current time 604 to a particular usage profile that represents similar usage patterns, as described above.

Usage analytics server 322 may use the determined matching usage profile to fulfill requests for usage analytics data. For example, at the current time 604, media content access device 314 may detect a request to render a GUI screen of a user interface. In response, media content access device 314 may query usage analytics server 322 for available usage analytics data. Usage analytics server 322 may receive the request and identify, from multiple usage profiles 506-1 and 506-2, a "best-fit" usage profile for the request. In certain embodiments, for example, current usage (i.e., at or immediately prior to the current time 604) may be matched to a particular usage profile within the multiple usage profiles 506-1 and 506-2. For instance, usage analytics server 322 may determine that the current time 604 is within the third time period 602-3 and/or that the usage data collected during the third time period 602-3 or at or immediately prior to the current time 604 is best matched to usage profile 506-1 (e.g., based on the matching or similar frequency in accessing of sports channels), as described above. In response, usage analytics server 322 may provide the usage analytics data included in usage profile 506-1 to media content access device 314 in response to the request. This may promote dynamic rendering of the GUI screen based on usage analytics data that represents a usage pattern that is the same or similar to a current usage pattern exhibited by media content access device 314.

In some examples, usage profiles 506 may coincide one-to-one with users of media content access device 314 and/or user profiles for the users. For instance, usage profile 506-1 may include usage analytics data that represents patterns of usage by a first user (e.g., a father of a family), and usage profile 506-2 may include usage analytics data that represents patterns of usage by a second user (e.g., a child of the family). Accordingly, user interfaces may be dynamically customized during rendering based on different users' detected distinct historical patterns of usage.

In other examples, usage profiles 506 may not coincide one-to-one with users of media content access device 314 or the user profiles for the users. For instance, usage profile 506-1 may include usage analytics data that represents a first pattern of usage by user 316 (e.g., based on how the user 316 typically uses a media content service each morning), and usage profile 506-2 may include usage analytics data that represents a second pattern of usage by the same user 316 (e.g., based on how the user 316 typically uses the media content service each evening). Accordingly, user interfaces may be dynamically customized during rendering based on a historical pattern of usage that is selected from a single user's multiple distinct historical patterns of usage.

The detection of distinct patterns of usage may be beneficial in embodiments in which media content access device 314 does not track which of a group of users is interacting with the media content access device 314. For example, media content access device 314 may be unaware of when one user relinquishes input device 318 to another user. However, if the users exhibit distinct patterns of usage of media content access device 314, usage analytics server 322 may detect and assign data representative of the distinct patterns of usage to separate usage profiles, as described above.

In other embodiments, media content access device 314 may track which of a group of users is interacting with the media content access device 314. For example, media content access device 314 may prompt each user to login in order to interact with the media content access device 314. In such embodiments, usage data provided while a user is logged in may be associated with the user's user profile. The user profile may contain one or more usage profiles each representing a distinct pattern of usage exhibited by the user.

The above-described examples relate to usage analytics data generated from usage data that is specific to a single media content access device 314 that is configured to dynamically render a user interface based on the usage analytics data. Such usage analytics data may be referred to as "local usage analytics data," which may include any usage analytics data that is generated exclusively from usage data provided by the same media content access device 314 that will use the data to dynamically render a user interface.

Additionally or alternatively, usage analytics data generated and maintained by usage analytics server 322 may be generated from usage data provided by one or more other media content access devices that may be included in implementation 300. This type of usage analytics data may be referred to as "global usage analytics data," which may include any usage analytics data that is generated from an aggregation of usage data provided by multiple media content access devices (e.g., one or more media content access devices other than media content access device 314, or a combination of media content access device 314 and one or more other media content access devices).

Global usage analytics data may represent one or more patterns of usage exhibited, in the aggregate, by one or more end users of a media content service distributed by implementation 300. Thus, global usage analytics data may represent any of the usage patterns described herein in relation to local usage analytics data, except that the usage patterns represented by the global usage analytics data represent global usage patterns in the aggregate across multiple media content access devices, users, and/or user subscriptions. For example, global usage analytics data may include data representing frequency of usage of one or more media content services and one or more media content programs, features, and/or functions of the media content service(s). To illustrate, global usage analytics data may indicate that for a group of media content access devices, users, and/or user subscriptions (e.g., a group of media content access devices and/or users served by VHO 304), a particular menu option in a GUI screen is popular in that it is more frequently accessed by the group than one or more other menu options in the GUI screen.

Hence, usage analytics server 322 may generate and maintain usage analytics data that may include local and/or global usage analytics data, which may be used separately or in combination (e.g., in weighted combination as specified by settings data 118 maintained by settings facility 108) to dynamically render a user interface based on the usage analytics data. For example, during a configuration session, user 316 may define settings indicating that user interface facility 106 is to use both local and global usage analytics data, when available, to dynamically render a user interface (or a particular GUI screen within the user interface). User 316 may be able to further specify a weight to be given to each type of data when both are used (e.g., eighty percent to local data and twenty percent to global data).

In certain examples, user 316 may be able to provide settings to define a particular group of users (e.g., a group of friends) to be used by usage analytics server 322 to generate global usage analytics data for access and use by media content access device 314 in dynamically rendering a user interface. This may allow a user interface to be dynamically rendered by media content access device 314 based on global usage analytics data associated with a select group of users. Accordingly, the user interface may be dynamically customized based on usage patterns of the groups of users, which may indicate certain user interface elements that are popular among the group of users.

Examples of dynamic user interface rendering based on usage analytics data will now be described. In certain embodiments, media content access device 314 may be configured to render a user interface, including a GUI screen of a GUI, either in accordance with a static default configuration of the user interface maintained by the media content access device 314 to render a static version of the user interface or based on usage analytics data to render a dynamic version of the user interface that is customized based on historical usage patterns.

Figure 7:
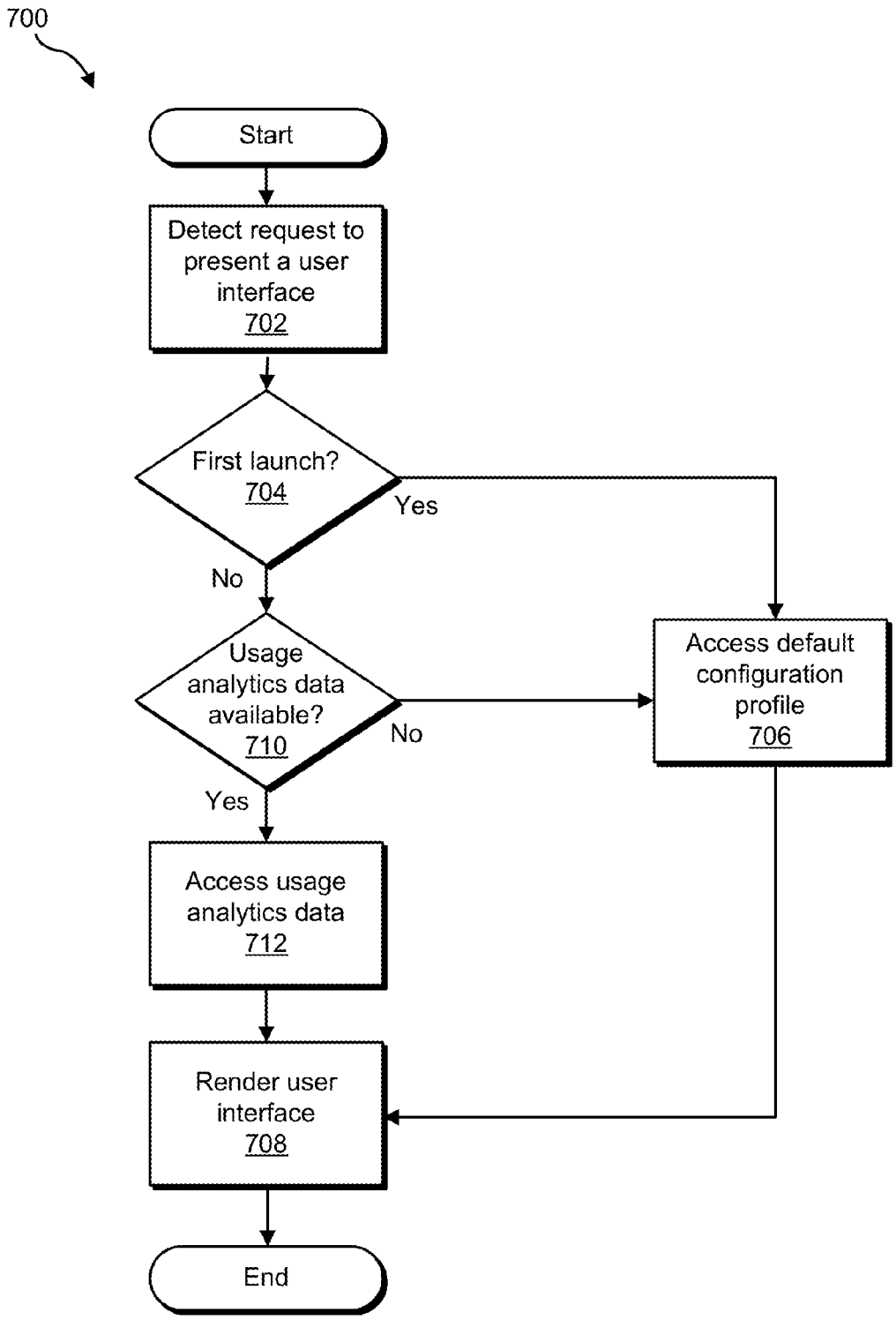
FIG. 7 illustrates an exemplary method of rendering a user interface according to principles described herein.

To illustrate, FIG. 7 shows an exemplary method 700 of rendering a user interface. While FIG. 7 illustrates exemplary steps according to one embodiment, other embodiments may omit, add to, reorder, combine, and/or modify any of the steps shown in FIG. 7. While method 700 is described as being performed by media content access device 314, the steps shown in FIG. 7 may be performed by user interface facility 106, access subsystem 204, media content access device 314, and/or user interface engine 408.

In step 702, media content access device 314 detects a request to present a user interface. The request may be detected in any suitable way. For example, the request may be received as an input command from input device 318 and/or from an internal component of media content access device 314. The request may be for a launch of a user interface application and/or for rendering and display of a particular GUI screen included in the user interface. The remaining steps of method 700 may be performed in response to the detection of the request to present the user interface in step 702.

In step 704, media content access device 314 determines whether the detected request is for a first launch of the user interface. For example, the request for presentation of the user interface may be a first launch of the user interface when media content access device 314 is powered on for the first time, initialized, or upgraded. If the requested presentation of the user interface is determined to be a first launch of the user interface in step 704, method 700 continues at step 706.

In step 706, media content access device 314 accesses a default configuration profile. The default configuration profile, which may be stored locally at media content access device 314 in certain embodiments or remotely of media content access device 314 in other embodiments, defines a static default configuration of the user interface. For example, the default configuration profile may define a static visual layout of one or more graphical elements of a GUI screen.

In step 708, media content access device 314 renders the user interface in accordance with the default configuration profile accessed in step 706. Accordingly, media content access device 314 renders a static default version of the user interface defined by the default configuration profile. Method 700 then ends.

Returning to step 704, if the requested presentation of the user interface is determined not to be a first launch of the user interface in step 704, method 700 continues at step 710. In step 710, media content access device 314 determines whether usage analytics data is available. The determination may be made in any suitable way. For example, media content access device 314 may determine whether a connection with usage analytics server 322 is available. If a connection is not available, media content access device 314 will determine that usage analytics data is unavailable. If a connection is available, media content access device 314 may query usage analytics server 322 for usage analytics data. If usage analytics server 322 is unable to provide usage analytics data in response to the query, usage analytics server 322 may provide, and media content access device 314 may receive, a notification that the usage analytics data is unavailable.

In response to the determination that usage analytics data is unavailable at step 710, method 700 may continue at step 706, in which step the default configuration profile for the user interface will be accessed as described above. Media content access device 314 then renders the user interface in accordance with the default configuration profile in step 708, as described above. Method 700 then ends.

Returning to step 710, if usage analytics data is determined to be available in step 710, method 700 will continue at step 712. In step 712, media content access device 314 accesses the usage analytics data. For example, media content access device 314 may request and receive usage analytics data from usage analytics server 322.

Method 700 then continues at step 708. In step 708, media content access device 314 renders the user interface based on the usage analytics data accessed in step 712. The rendering of the user interface in this case is performed dynamically such that one or more properties of the user interface (that would have otherwise been fixed if rendered in accordance with the default configuration profile as described above) are dynamically customized based on the usage analytics data. Accordingly, the user interface rendered in step 708 is dynamically customized based on historical usage patterns represented by the usage analytics data.

Figure 8:
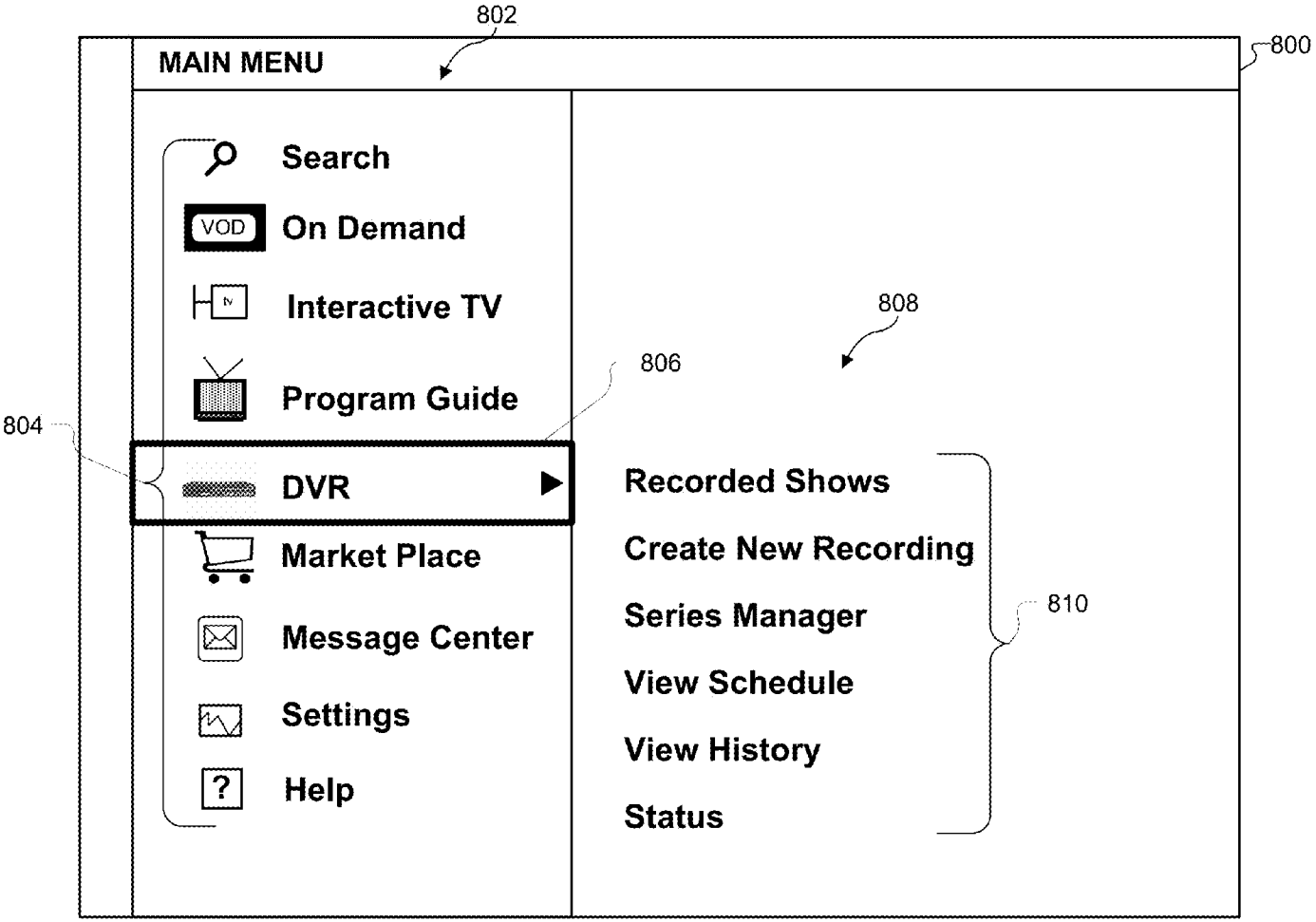
FIGS. 8-10 illustrate exemplary rendered versions of a graphical user interface screen according to principles described herein.
Figure 9:
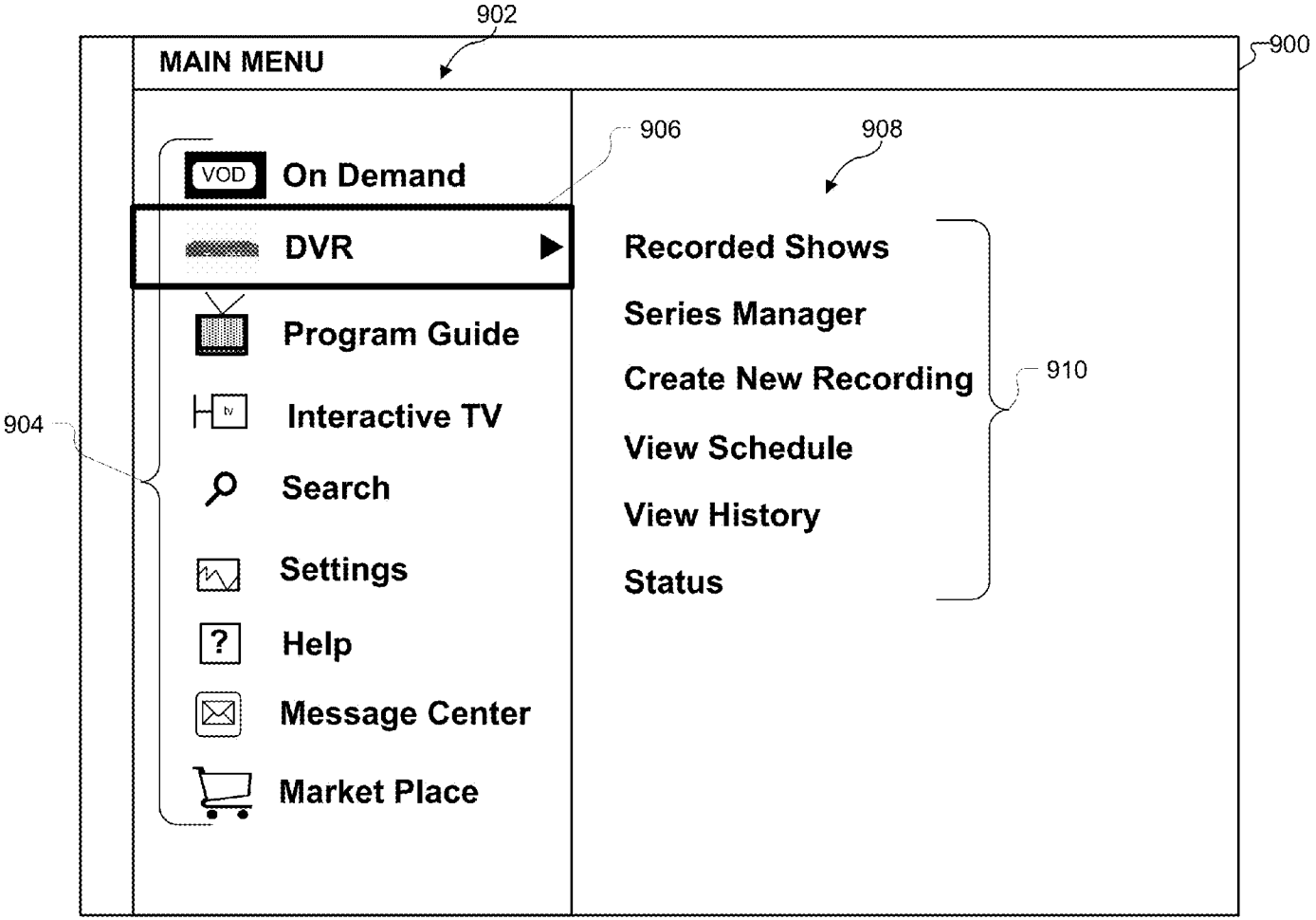
Figure 10:
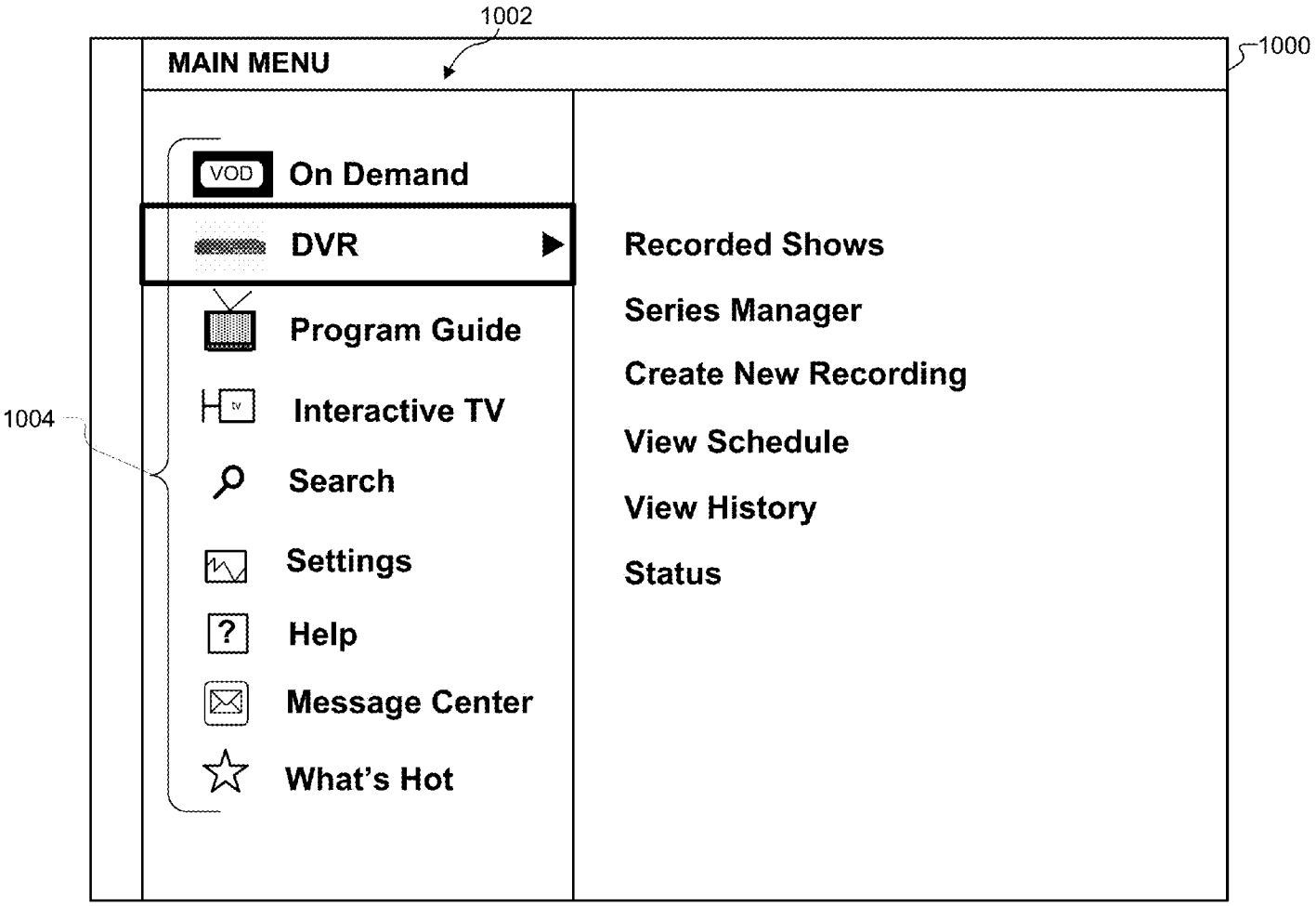

To further illustrate, FIGS. 8-10 show exemplary rendered versions of a GUI screen that may be part of a user interface provided by media content access device 314. FIG. 8 shows a static version 800 of the GUI screen rendered in accordance with a default configuration profile. As shown, the GUI screen may comprise a menu screen (e.g., a "Main menu" screen) with which user 316 may interact to select one or more menu options represented in the GUI screen in order to access one or more features, which correspond to the one or more menu options, of a media content service. As shown, GUI screen may include a first list 802 of selectable menu options 804. In version 800 of the GUI screen, the list 802 of menu options 804 includes a "search" option, an "on demand" option, an "interactive TV" option, a "program guide" option, a "DVR" option, a "market place" option, a "message center" option, a "settings" option, and a "help" option arranged in that order from top to bottom of the list 802.

As further shown in FIG. 8, a selector 806 may be positioned to select the "DVR" option included in the list 802. In response to the selection of the "DVR" option, a second list 808 of selectable menu options 810 related to the selected "DVR" option is displayed in the GUI screen. As shown, the second list 808 of menu options 810 includes a "recorded shows" option, a "create new recording" option, a "series manager" option, a "view schedule" option, a "view history" option, and a "status" option arranged in that order from top to bottom of the list 808.

If the default configuration profile were always used to render version 800 of the GUI screen, media content access device 314 would repeatedly render the same static version 800 of the GUI screen across the lifespan of the default configuration profile and/or media content access device 314. This may limit the potential quality of the user experience with the GUI screen. However, one or more of the principles described herein may be implemented by media content access device 314 to dynamically render custom versions of the GUI screen based on one or more historical usage patterns represented by usage analytics data, as described herein.

To illustrate, FIG. 9 shows a dynamic version 900 of the GUI screen dynamically rendered by media content access device 314 based on usage analytics data. As shown, version 900 of the GUI screen includes a first list 902 of selectable menu options 904. In this particular example, the first list 902 of menu options 904 includes the same menu options 804 included in the first list 802 of version 800 of the GUI screen shown in FIG. 8, except that the order of the menu options 904 in the first list 902 of version 900 is dynamic and different (e.g., has been dynamically modified). In some examples, dynamic version 900 may be rendered by dynamically rearranging and/or reordering menu options 804 of static version 800 of the GUI screen to create dynamic list 902 of menu options 904 in dynamic version 900 of the GUI screen. As shown, the dynamically rendered first list 902 of menu options 904 includes an "on demand" option, a "DVR" option, a "program guide" option, an "interactive TV" option, a "search" option, a "settings" option, a "help" option, a "message center" option, and a "market place" option arranged in that order from top to bottom of the list 902.

As further shown in FIG. 9, a selector 906 may be positioned to select the "DVR" option included in the list 902. In response to the selection of the "DVR" option, a second list 908 of selectable menu options 910 related to the selected "DVR" option is displayed in the GUI screen. In this particular example, the second list 908 of menu options 910 includes the same menu options 810 included in the second list 808 of version 800 of the GUI screen shown in FIG. 8, except that the order of the menu options 910 in the second list 908 of version 900 is different (e.g., has been dynamically modified). In some examples, dynamic version 900 may be rendered by dynamically rearranging and/or reordering menu options 810 of static version 800 of the GUI screen to create dynamic list 908 of menu options 910 in dynamic version 900 of the GUI screen. As shown, the dynamically rendered second list 908 of menu options 910 includes a "recorded shows" option, a "series manager" option, a "create new recording" option, a "view schedule" option, a "view history" option, and a "status" option arranged in that order from top to bottom of the list 908.

Thus, static version 800 includes static lists 802 and 808 having static orders of menu options, and dynamic version 900 includes dynamic lists 902 and 908 having dynamic orders of menu options that are dynamically determined during rendering of dynamic version 900 of the GUI screen based on usage analytics data. In the illustrated example, the dynamic orders of menu options in lists 902 and 908 are customized and different from the static orders of menu options in lists 802 and 808. In this or a similar manner, a static property of static version 800 of the GUI screen may be dynamically modified to create dynamic, custom property in a dynamic version (e.g., dynamic version 900) of the GUI screen.

The order of menu options in a list of menu options in a GUI screen may be dynamically arranged, such as is illustrated by FIG. 9, based on one or more historical usage patterns. This may create a GUI screen having one or more properties that fit historical usage patterns and may potentially improve the experience of a user with the GUI screen. For example, usage analytics data may indicate that user 316 historically accesses certain menu options more than other menu options. Based on this data, the more frequently accessed menu options may be dynamically positioned at or near the top of a list of menu options while less frequently accessed menu options may be dynamically positioned further down the list of menu options. This may make the more frequently accessed menu options more convenient for user 316 to access when interacting with the GUI screen.

To illustrate, of the menu options 804 in list 802 shown in FIG. 8, over time user 316 may most frequently access the "on demand" option, next most frequently access the "DVR" option, and least frequently access the "market place" option. Based on this relative frequency of access of menu options 804 over time, as indicated in usage analytics data, media content access device 314 may dynamically render version 900 of the GUI screen in which the "on demand" option is positioned as the first entry in list 902, the "DVR" option is positioned as the second entry in list 902, and so on by order of frequency until the "market place" option is positioned at the bottom of list 902. Accordingly, the most frequently accessed menu option may be positioned in the GUI screen at a location at which the menu option may be conveniently selected by user 316, which may help to enhance the experience user 316 has interacting with the GUI screen.

While FIG. 9 illustrates exemplary dynamic rearrangements of menu options within lists of menu options based on historical usage patterns, this is illustrative only. One or more other properties of a user interface (that would be otherwise static in a static version of the user interface) may be dynamically selected and/or modified (from a default configuration) based on historical usage patterns. For example, one or more properties defining the visual layout of a GUI screen may be dynamically customized, such as by rearranging the positions of graphical elements within the GUI screen. As another example, content of a GUI screen may be dynamically added or deleted to create a dynamic version of a GUI screen, such as by adding or deleting menu options to/from a list of menu options.

To illustrate, FIG. 10 shows a dynamic version 1000 of a GUI screen dynamically rendered by media content access device 314 based on usage analytics data. As shown, version 1000 of the GUI screen includes a first list 1002 of selectable menu options 1004. The first list 1002 of menu options 1004 includes the same menu options 904 included in the first list 902 of version 900 of the GUI screen shown in FIG. 9, except that list 1002 includes a new "what's hot" option and omits the "market place" option. In some examples, dynamic version 1000 may be rendered by media content access device 314 dynamically selecting, from a group of menu options that may be included in list 1002, a subset of the menu options for inclusion as menu options 1004 in dynamic version 1000 of the GUI screen. For example, the selected subset may include menu options 1004 that are historically the most frequently accessed options.

In certain examples, the dynamic selection of menu options 1004 may help promote a new or popular feature of a media content service to user 316. To illustrate, a provider of the service may create a "what's hot" feature configured to notify and facilitate user access of media content programs that are popular (e.g., most frequently accessed) among a group of users of the service. A "what's hot" option may be made to appear in a GUI screen of a user interface provided by media content access device 314, such as in a video-on-demand menu screen. While user 316 may be able to access the "what's hot" option in the video-on-demand menu screen to access popular video-on-demand programs, for whatever reason user 316 may not select the "what's hot" option over time (e.g., user 316 does see the option or use the video-on-demand menu screen often). However, other users of the service may frequently select the "what's hot" option such that the "what's hot" feature becomes, in aggregate, a popular (e.g., relatively frequently accessed) feature of the service.

Global usage analytics data may reflect that the "what's hot" feature and/or option are popular among a group of users, and this data may be used by media content access device 314 to dynamically render a GUI screen. For example, media content access device 314 may render dynamic version 1000 of the GUI screen shown in FIG. 10 based at least in part on the global usage analytics data such that list 1002 of menu options 1004 is dynamically customized to include the "what's hot" option (which option, absent dynamic rendering, would appear only in a different GUI screen of the user interface). In this or a similar manner, an option and/or feature that is popular among a group of users may be promoted to user 316 to encourage user 316 to utilize the option and/or feature that is popular with other users.

The "what's hot" option may be substituted for the "market place" option to create list 1002. The "market place" option may be selected for substitution or omission from list 1002 based on usage analytics data indicating relatively infrequent user selection of the "market place" option.

Figure 11:
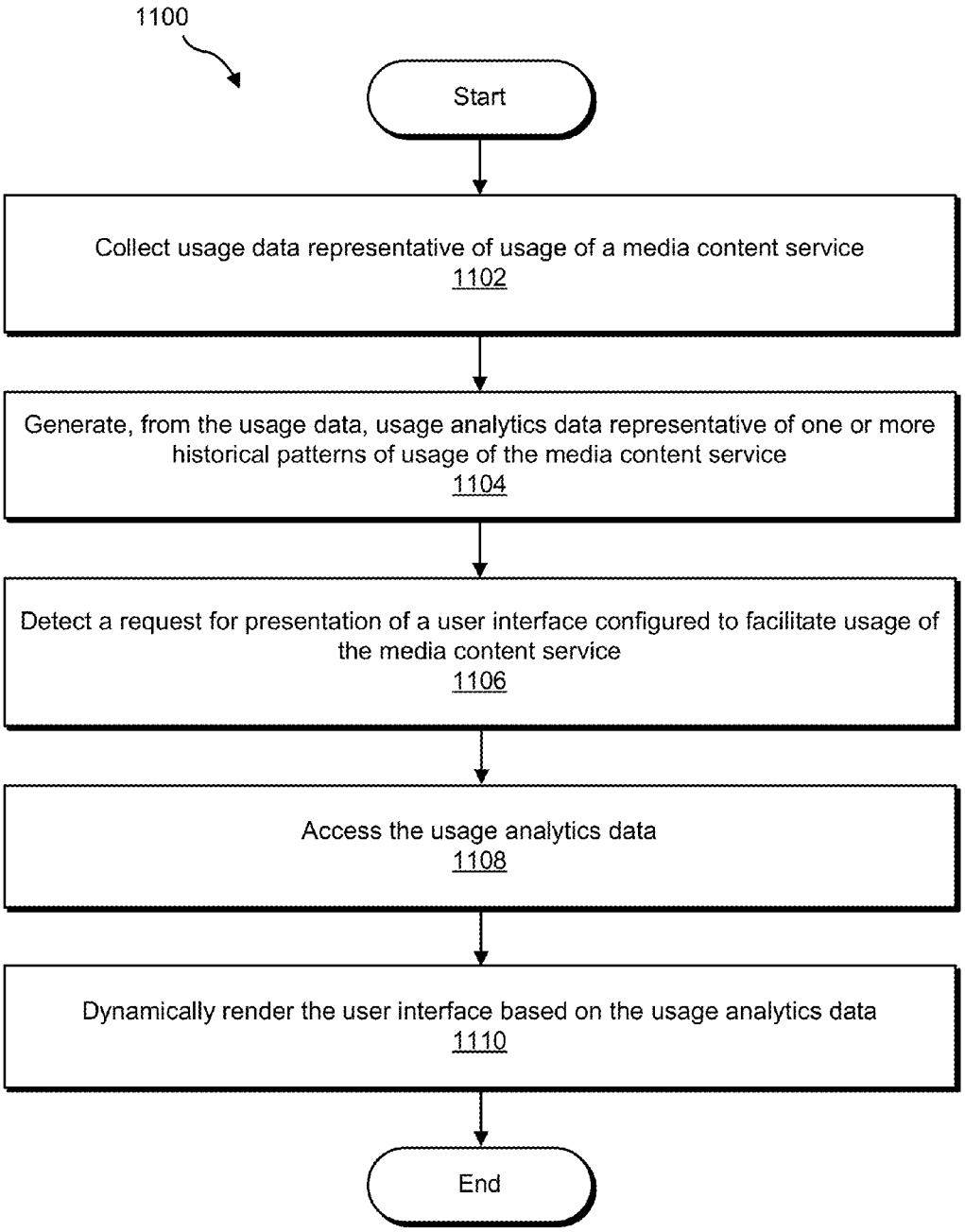
FIG. 11 illustrates an exemplary dynamic user interface method according to principles described herein.

FIG. 11 illustrates an exemplary dynamic user interface method 1100 that includes tracking usage of a distributed media content service and dynamically rendering a user interface configured to facilitate usage of the service. While FIG. 11 illustrates exemplary steps according to one embodiment, other embodiments may omit, add to, reorder, combine, and/or modify any of the steps shown in FIG. 11. While steps of method 1100 are described as being performed by system 100, the steps shown in FIG. 11 may be performed one or more components of system 100, system 200, and/or implementation 300.

In step 1102, system 100 collects usage data representative of usage of a media content service. Step 1102 may be performed in any of the ways described herein, including by media content access device 314 transmitting and usage analytics server 322 receiving raw usage data representative of usage of the media content service by media content access device 314. Additionally or alternatively, the collection of usage data in step 1102 may include usage analytics server 322 receiving raw usage data from one or more other media content access devices configured to access the media content service.

In step 1104, system 100 generates, from the usage data, usage analytics data representative of one or more historical patterns of usage of the media content service. Step 1104 may be performed in any of the ways described herein.

In step 1106, system 100 detects a request for presentation of the user interface configured to facilitate usage of the media content service. Step 1106 may be performed in any of the ways described herein.

In step 1108, system 100 accesses the usage analytics data. Step 1108 may be performed in any of the ways described herein, including by media content access device 314 requesting and receiving usage analytics data from a remote source such as usage analytics server 322.

In step 1110, system 100 dynamically renders the user interface based on the usage analytics data. Step 1110 may be performed in any of the ways described herein, including by media content access device 314 rendering a dynamic version of the user interface based on the usage analytics data.

In certain embodiments, one or more of the components and/or processes described herein may be implemented and/or performed by one or more appropriately configured computing devices. To this end, one or more of the systems and/or components described above may include or be implemented by any computer hardware and/or computer-implemented instructions (e.g., software) embodied on a non-transitory computer-readable medium configured to perform one or more of the processes described herein. In particular, system components may be implemented on one physical computing device or may be implemented on more than one physical computing device. Accordingly, system components may include any number of computing devices, and may employ any of a number of computer operating systems.

In certain embodiments, one or more of the processes described herein may be implemented at least in part as instructions executable by one or more computing devices. In general, a processor (e.g., a microprocessor) receives instructions, from a non-transitory computer-readable medium, (e.g., a memory, etc.), and executes those instructions, thereby performing one or more processes, including one or more of the processes described herein. Such instructions may be stored using any of a variety of known non-transitory computer-readable media.

A non-transitory computer-readable medium (also referred to as a processor-readable medium) includes any non-transitory medium that participates in providing data (e.g., instructions) that may be read by a computer (e.g., by a processor of a computer). Such a non-transitory medium may take many forms, including, but not limited to, non-volatile media and/or volatile media. Non-volatile media may include, for example, optical or magnetic disks and other persistent memory. Volatile media may include, for example, dynamic random access memory ("DRAM"), which typically constitutes a main memory. Common forms of non-transitory computer-readable media include, for example, a floppy disk, flexible disk, hard disk, magnetic tape, any other magnetic medium, a CD-ROM, DVD, any other optical medium, a RAM, a PROM, an EPROM, a FLASH-EEPROM, any other memory chip or cartridge, or any other non-transitory medium from which a computer can read.

Figure 12:
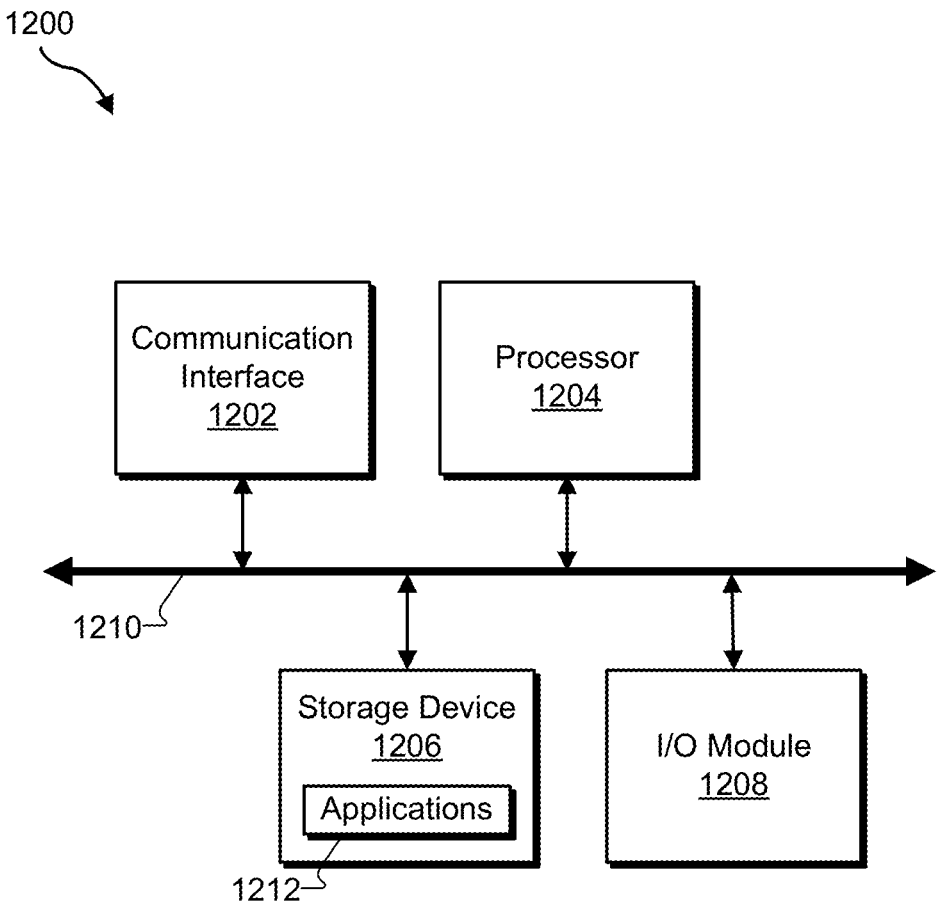
FIG. 12 illustrates an exemplary computing device according to principles described herein.

FIG. 12 illustrates an exemplary computing device 1200 that may be configured to perform one or more of the processes described herein. As shown in FIG. 12, computing device 1200 may include a communication interface 1202, a processor 1204, a storage device 1206, and an input/output ("I/O") module 1208 communicatively connected via a communication infrastructure 1210. While an exemplary computing device 1200 is shown in FIG. 12, the components illustrated in FIG. 12 are not intended to be limiting. Additional or alternative components may be used in other embodiments. Components of computing device 1200 shown in FIG. 12 will now be described in additional detail.

Communication interface 1202 may be configured to communicate with one or more computing devices. Examples of communication interface 1202 include, without limitation, a wired network interface (such as a network interface card), a wireless network interface (such as a wireless network interface card), a modem, and any other suitable interface. Communication interface 1202 may additionally or alternatively provide such a connection through, for example, a local area network (such as an Ethernet network), a personal area network, a telephone or cable network, a satellite data connection, or any other suitable connection. Communication interface 1202 may be configured to interface with any suitable communication media, protocols, and formats, including any of those mentioned above.

Processor 1204 generally represents any type or form of processing unit capable of processing data or interpreting, executing, and/or directing execution of one or more of the instructions, processes, and/or operations described herein. Processor 1204 may direct execution of operations in accordance with one or more applications 1212 or other computer-executable instructions such as may be stored in storage device 1206 or another non-transitory computer-readable medium.

Storage device 1206 may include one or more data storage media, devices, or configurations and may employ any type, form, and combination of data storage media and/or device. For example, storage device 1206 may include, but is not limited to, a hard drive, network drive, flash drive, magnetic disc, optical disc, random access memory ("RAM"), dynamic RAM ("DRAM"), other non-volatile and/or volatile data storage units, or a combination or sub-combination thereof. Electronic data, including data described herein, may be temporarily and/or permanently stored in storage device 1206. For example, data representative of one or more executable applications 1212 (which may include, but are not limited to, one or more of the software applications described herein) configured to direct processor 1204 to perform any of the operations described herein may be stored within storage device 1206. In some examples, data may be arranged in one or more databases residing within storage device 1206.

I/O module 1208 may be configured to receive user input and provide user output and may include any hardware, firmware, software, or combination thereof supportive of input and output capabilities. For example, I/O module 1208 may include hardware and/or software for capturing user input, including, but not limited to, a keyboard or keypad, a touch screen component (e.g., touch screen display), a receiver (e.g., an RF or infrared receiver), and/or one or more input buttons.

I/O module 1208 may include one or more devices for presenting output to a user, including, but not limited to, a graphics engine, a display (e.g., a display screen, one or more output drivers (e.g., display drivers), one or more audio speakers, and one or more audio drivers. In certain embodiments, I/O module 1208 is configured to provide graphical data to a display for presentation to a user. The graphical data may be representative of one or more graphical user interfaces and/or any other graphical content as may serve a particular implementation.

In some examples, any of the facilities described herein may be implemented by or within one or more components of computing device 1200. For example, one or more applications 1212 residing within storage device 1206 may be configured to direct processor 1204 to perform one or more processes or functions associated with usage tracking facility 102, usage analytics facility 104, user interface facility 106, and/or settings facility 108. Likewise, storage facility 110 may be implemented by or within storage device 1206.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A method comprising:

collecting, by a media content access device over time, raw usage data representative of usage, by the media content access device, of a media content service without tracking which user is using the media content service;

transmitting, by the media content access device to a usage analytics server, the raw usage data representative of the usage of the media content service;

detecting, by the media content access device, a request for a presentation of a user interface associated with the media content service;

transmitting, by the media content access device to the usage analytics server in response to the detecting of the request for the presentation of the user interface, a request for usage analytics data representative of multiple distinct historical patterns of usage of the media content service, the usage analytics data comprising:

local usage analytics data generated from the raw usage data representative of the usage, by the media content access device, of the media content service, and global usage analytics data generated from an aggregation of additional raw usage data received by the usage analytics server from a plurality of additional media content access devices and representative of usage, by the plurality of additional media content access devices over time, of the media content service;

determining, by the media content access device in response to the request for the usage analytics data, whether the usage analytics data is available;

rendering, by the media content access device if the usage analytics data is determined to be unavailable, a static default version of the user interface in accordance with data representative of a static default configuration of the user interface; and rendering, by the media content access device if the usage analytics data is determined to be available, a dynamic version of the user interface based on a combination of:

a distinct set of the local usage analytics data representative of a distinct historical pattern of usage that is selected from among the multiple distinct historical patterns of usage and that best matches a current pattern of usage of the media content service by the media content access device, and the global usage analytics data.

2. The method of claim 1, wherein the media content service comprises a subscriber television programming service.

3. The method of claim 2, wherein the subscriber television programming service is configured to broadcast or multicast television programming over a media content distribution network in accordance with a predefined presentation schedule.

4. The method of claim 1, wherein the user interface comprises a graphical user interface screen including one or more menu options each configured to be selected by a user of the media content access device to access a corresponding feature of the media content service.

5. The method of claim 4, wherein:

the static default version of the user interface includes a static list of the one or more menu options arranged in a static order within the static list in accordance with the static default configuration of the user interface;

the dynamic version of the user interface includes a dynamic list of the one or more menu options arranged in a dynamic order within the dynamic list based on the combination of the distinct set of the local usage analytics data and the global usage analytics data; and the dynamic order is different from the static order.

6. The method of claim 4, wherein the usage analytics data indicates historical frequency of access of each of the one or more menu options or the corresponding feature of the media content service.

7. The method of claim 4, wherein the dynamic version of the user interface includes:

a first menu option arranged within the graphical user interface screen based on the local usage analytics data, and a second menu option arranged within the graphical user interface screen based on the global usage analytics data.

8. The method of claim 1, wherein:

the static default version of the user interface includes a static set of menu options;

the dynamic version of the user interface includes a dynamic set of menu options; and the dynamic set of menu options includes at least one menu option not included in the static set of menu options.

9. The method of claim 1, wherein:

the static default version of the user interface includes a static property; and the rendering of the dynamic version of the user interface based on the combination of the distinct set of the local usage analytics data and the global usage analytics data dynamically modifies the static property in the dynamic version of the user interface.

10. The method of claim 1, wherein the local usage analytics data generated from the raw usage data indicates a frequency of access, by the media content access device, of at least one of:

a feature of the media content service;

a user interface element included in the user interface;

a type of media content channel; and a type of media content.

11. The method of claim 1, wherein the transmitting of the raw usage data includes indirectly transmitting the raw usage data to the usage analytics server by way of signaling associated with the media content access device accessing the media content service.

12. The method of claim 1, further comprising:

receiving, by the usage analytics server, the raw usage data transmitted by the media content access device;

generating, by the usage analytics server, the local usage analytics data from the raw usage data; and maintaining, by the usage analytics server, the local usage analytics data for access by the media content access device.

13. The method of claim 12, wherein the generating of the local usage analytics data comprises:

identifying the multiple distinct historical patterns of usage from the raw usage data;

generating multiple usage profiles; and storing the local usage analytics data in the multiple usage profiles such that each usage profile includes a distinct set of local usage analytics data representative of a distinct historical pattern of usage included in the multiple distinct historical patterns of usage.

14. The method of claim 13, further comprising:

receiving, by the usage analytics server from the media content access device, the request for the usage analytics data;

selecting, by the usage analytics server, a usage profile from the multiple usage profiles that includes the distinct set of the local usage analytics data representative of the distinct historical pattern of usage that best matches the current pattern of usage of the media content service; and transmitting, by the usage analytics server, the distinct set of the local usage analytics data included in the selected usage profile to the media content access device.

15. The method of claim 14, wherein the rendering of the dynamic version of the user interface based on the combination of the distinct set of the local usage analytics data and the global usage analytics data comprises rendering at least a portion of the dynamic version of the user interface based on the distinct set of the local usage analytics data transmitted by the usage analytics server to the media content access device.

16. The method of claim 1, wherein:

the data representative of the static default configuration of the user interface is stored locally within the media content access device; and the usage analytics data is stored remotely of the media content access device.

17. The method of claim 1, embodied as computer-executable instructions on at least one non-transitory computer-readable medium.

18. The method of claim 1, further comprising:

receiving, by the media content access device, user input specifying a first weight assigned to the local usage analytics data and a second weight assigned to the global usage analytics data, wherein the rendering of the dynamic version of the user interface is based on a weighted combination of the distinct set of the local usage analytics data and the global usage analytics data in accordance with the first weight assigned to the local usage analytics data and the second weight assigned to the global usage analytics data.

19. The method of claim 1, further comprising:

receiving, by the media content access device, user input specifying the plurality of additional media content access devices to be used in generating the global usage analytics data, the user input comprising user selection of one or more of:

a plurality of users associated with the plurality of additional media content access devices, a plurality of subscriptions associated with the plurality of additional media content access devices, and the plurality of additional media content access devices.

20. An apparatus comprising:

a processor;

a usage tracking facility that directs the processor to:

collect, over time, raw usage data representative of usage, by the apparatus, of a media content service without tracking which user is using the media content service; and transmit, to a usage analytics server, the raw usage data representative of the usage of the media content service, a user interface facility that directs the processor to:

detect a request for a presentation of a user interface associated with the media content service;

transmit, to the usage analytics server in response to detecting the request for the presentation of the user interface, a request for usage analytics data representative of multiple distinct historical patterns of usage of the media content service, the usage analytics data comprising:

local usage analytics data generated from the raw usage data representative of the usage, by the apparatus, of the media content service, and global usage analytics data generated from an aggregation of additional raw usage data received by the usage analytics server from a plurality of additional apparatuses and representative of usage, by the plurality of additional apparatuses over time, of the media content service;

determine, in response to the request for the usage analytics data, whether the usage analytics data is available;

render, if the usage analytics data is determined to be unavailable, a static default version of the user interface in accordance with data representative of a static default configuration of the user interface; and render, if the usage analytics data is determined to be available, a dynamic version of the user interface based on a combination of:

a distinct set of the local usage analytics data representative of a distinct historical pattern of usage included in the multiple distinct historical patterns of usage that is selected from among the multiple distinct historical patterns of usage and that best matches a current pattern of usage of the media content service, and the global usage analytics data, wherein the static default version of the user interface includes a static user interface property, and the dynamic version of the user interface includes a custom user interface property that is rendered by dynamically modifying the static user interface property based on at least one of the distinct set of the local usage analytics data and the global usage analytics data.

21. The apparatus of claim 20, wherein:

the media content service comprises a subscriber television programming service; and the apparatus comprises a set-top box device configured to access the subscriber television programming service.

22. A system comprising:

a plurality of media content access devices; and a media content delivery subsystem communicatively coupled to the plurality of media content access devices and configured to:

distribute a media content service over a media content distribution network;

receive, from the plurality of media content access device, raw usage data representative of usage of the media content service by the plurality of media content access devices;

track usage of the media content service by the plurality of media content access devices, the tracking including generating, from the raw usage data received from the media content access device, usage analytics data representative of multiple distinct historical patterns of usage of the media content service, the usage analytics data comprising:

local usage analytics data generated from raw usage data representative of usage, by a media content access device included in the plurality of media content access devices, of the media content service, and global usage analytics data generated from an aggregation of raw usage data representative of usage, by a group of additional media content access devices included in the plurality of media content access devices, of the media content service; and track a current pattern of usage of the media content service by the media content access device;

wherein the media content access device is configured to:

access the media content service distributed over the media content distribution network;

collect, over time, the raw usage data representative of the usage of the media content service by the media content access device without tracking which user is interacting with the media content access device;

transmit, to the media content delivery subsystem, the raw usage data representative of the usage of the media content service by the media content access device;

detect a request for a presentation of a user interface configured to facilitate user interaction with the media content access device;

transmit, to the media content delivery subsystem in response to detecting the request for the presentation of the user interface, a request for the usage analytics data;

determine, in response to the request for the usage analytics data, whether the usage analytics data is available;

render, if the usage analytics data is determined to be unavailable, a static default version of the user interface in accordance with data representative of a static default configuration of the user interface; and render, if the usage analytics data is determined to be available, a dynamic version of the user interface based on a combination of:

a distinct set of the local usage analytics data representative of a distinct historical pattern of usage that is selected from among the multiple distinct historical patterns of usage and that best matches the current pattern of usage of the media content service, and the global usage analytics data.

23. The system of claim 22, wherein:

the static default version of the user interface includes a static user interface property; and the dynamic version of the user interface includes a custom user interface property that is rendered by dynamically modifying the static user interface property based on at least one of the distinct set of the local usage analytics data and the global usage analytics data.

24. The system of claim 22, wherein the media content delivery subsystem is further configured to generate the usage analytics data from the raw usage data by:

identifying the multiple distinct historical patterns of usage from the raw usage data;

generating multiple usage profiles; and storing the usage analytics data in the multiple usage profiles such that each usage profile includes a distinct set of usage analytics data representative of a distinct pattern of usage included in the multiple distinct historical patterns of usage.

25. A system comprising:

media content distribution network equipment located at a super head-end, a video hub office, and a video service office and configured to distribute a subscriber television programming service over a subscriber television programming distribution network;

a usage analytics server communicatively coupled to the media content distribution network equipment located at at least one of the super head-end, the video hub office, and the video service office; and a media content access device communicatively coupled to the video service office and the usage analytics server, wherein the usage analytics server is configured to:

track end-user usage of the subscriber television programming service, the tracking including generating, from raw usage data representative of usage of the subscriber television programming service, usage analytics data representative of multiple distinct historical patterns of usage of the subscriber television programming service, the usage analytics data comprising:

local usage analytics data generated from raw usage data representative of usage, by the media content access device, of the subscriber television programming service, and global usage analytics data generated from an aggregation of raw usage data representative of usage, by a group of additional media content access devices communicatively coupled to the video service office and the usage analytics server, of the subscriber television programming service; and wherein the media content access device is configured to:

access the subscriber television programming service distributed over the subscriber television programming network;

collect, over time, the raw usage data representative of the usage, by the media content access device, of the subscriber television programming service without tracking which user is interacting with the media content access device;

transmit, to the usage analytics server, the raw usage data representative of the usage, by the media content access device, of the subscriber television programming service;

detect a request for a presentation of a user interface configured to facilitate usage of the subscriber television programming service by a user of the media content access device;

transmit, to the usage analytics server in response to detecting the request for the presentation of the user interface, a request for the usage analytics data representative of the multiple distinct historical patterns of usage of the subscriber television programming service;

determine, in response to the request for the usage analytics data, whether the usage analytics data is available;

render, if the usage analytics data is determined to be unavailable, a static default version of the user interface in accordance with data representative of a static default configuration of the user interface; and render, if the usage analytics data is determined to be available, a dynamic version of the user interface based on a combination of:

a distinct set of the local usage analytics data representative of a distinct historical pattern of usage that is selected from among the multiple distinct historical patterns of usage and that best matches a current pattern of usage of the subscriber television programming service, and the global usage analytics data.

* * * * *